United States Patent [19]

Lambert

[11] Patent Number: 4,662,202

[45] Date of Patent: May 5, 1987

[54] LOW TENSION CASCADE MILL SPEED CONTROL BY CURRENT MEASUREMENT WITH TEMPERATURE COMPENSATION

[75] Inventor: William A. Lambert, Monroe, Mich.

[73] Assignee: Cargill, Incorporated, Minneapolis, Minn.

[21] Appl. No.: 758,161

[22] Filed: Jul. 23, 1985

[51] Int. Cl.[4] ..... B21B 37/10

[52] U.S. Cl. ..... 72/8; 72/13; 72/19; 72/205; 72/234; 364/472

[58] Field of Search ..... 72/13, 21, 19, 205, 72/6, 8, 234, 365, 366; 364/472

[56] References Cited

U.S. PATENT DOCUMENTS

| | | | |
|---|---|---|---|
| 3,418,834 | 12/1968 | Cook | 72/13 X |
| 3,540,248 | 11/1970 | Hostetter et al. | 72/13 X |
| 3,695,075 | 10/1972 | Kubota | 72/19 |
| 3,762,194 | 10/1973 | Maxwell | 72/19 X |
| 3,863,478 | 2/1975 | Harada et al. | 72/6 |
| 3,940,960 | 3/1976 | Tanifuji et al. | 72/19 |
| 4,003,230 | 1/1977 | Morooka et al. | 72/19 |
| 4,011,743 | 3/1977 | Peterson et al. | 72/12 |
| 4,063,076 | 12/1977 | Morooka et al. | 364/472 |
| 4,079,609 | 3/1978 | Hodgskiss | 72/6 |
| 4,087,859 | 5/1978 | Anbe | 364/472 |
| 4,126,028 | 11/1978 | Chapront | 72/19 |
| 4,137,742 | 2/1979 | Tanifuji et al. | 72/6 |
| 4,157,039 | 6/1979 | Kilmister et al. | 73/345 |
| 4,162,624 | 7/1979 | Morooka et al. | 72/8 |
| 4,230,975 | 10/1980 | Donatelli et al. | 318/6 |
| 4,236,216 | 11/1980 | Anbe | 364/472 |
| 4,284,937 | 8/1981 | Sekiguchi et al. | 318/388 |
| 4,292,825 | 10/1981 | Morooka et al. | 72/8 |
| 4,307,591 | 12/1981 | Peterson | 72/17 |
| 4,379,395 | 4/1983 | Konishi et al. | 72/8 |

*Primary Examiner*—R. L. Spruill
*Assistant Examiner*—Steve Katz
*Attorney, Agent, or Firm*—Fitch, Even, Tabin & Flannery

[57] ABSTRACT

A cascade speed control for tensionless production in a rolling mill by the measurement of stand motor current with temperature compensation. A low tension speed ratio between pairs of mill stands is calculated by successive incremental corrections. The corrections are based on the difference between a no tension current and a tension current for the motors of the mill stands as compensated for temperature variation. In one embodiment a compensation factor is calculated by taking the temperature difference of the material at the times the currents are measured and multiplying the difference by an empirical constant which relates the change in motor current to a change in temperature for a particular plant. Another embodiment illustrates temperature compensation by using current compensation values which are obtained by storing a no tension current profile for one of the mill stands. The low tension speed ratios between stands are maintained by cascading variations in the speed of a subsequent stand down to a previous stand.

20 Claims, 25 Drawing Figures

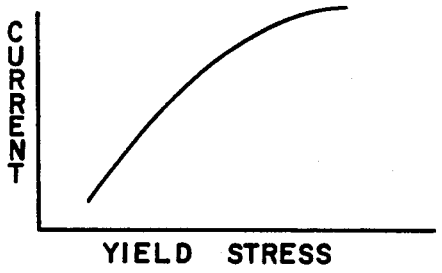
FIG. 3
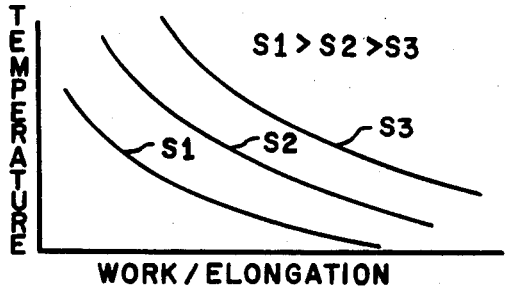
FIG. 4
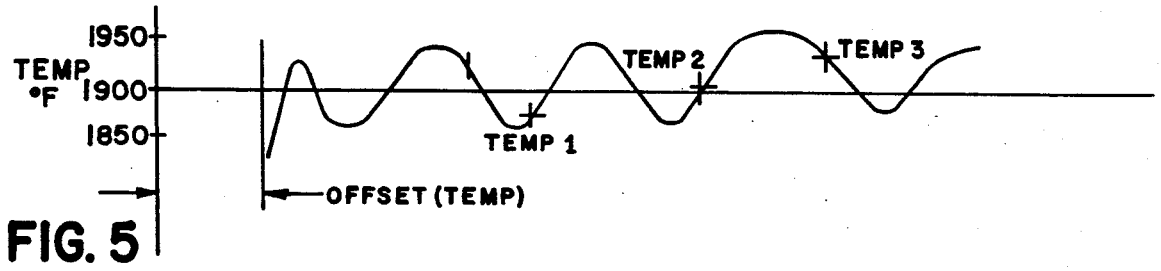
FIG. 5
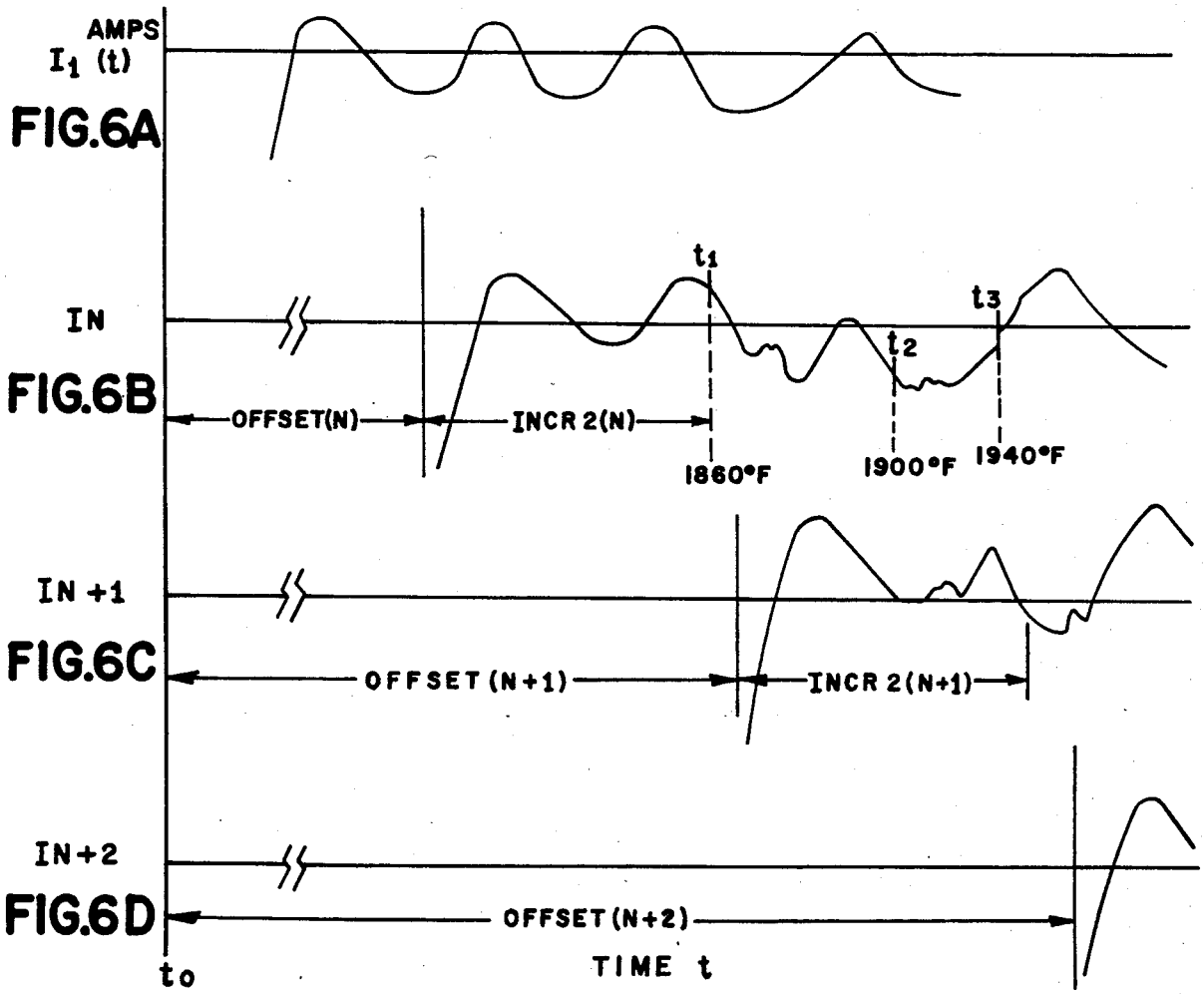

LOW TENSION CASCADE MILL SPEED CONTROL BY CURRENT MEASUREMENT WITH TEMPERATURE COMPENSATION

The invention pertains generally to method and apparatus for the stressless rolling of materials in a continuous rolling mill and is more particularly directed to measuring and controlling the tension in the material between adjacent mill stands by the measurement of the current drawn by the mill stand motors as adjusted for the temperature of the material being rolled.

During the rolling of elongated materials in continuous rolling mills, for example, wires, rods, shaped steel stock, etc., the product is simultaneously worked by several of the mill stands. The presence of a tractive force, either creating a tension or compression between the mill stands, causes distortions to occur in the required profile. Tension occurs when the drive motors of the mill stands are such that the natural flow rate of material leaving one mill stand is not equal to the flow rate entering the next mill stand. The tractive or tension force restores equilibrium by changing the billet speed relative to the roll speed but also detrimentally alters the way the material is deformed in the rolling process. The latter effect causes the billet cross-section to be different from design and variations in tension through the mill train will result in uncontrolled dimensional variation in the finished product. Therefore, it is advantageous to minimize or completely eliminate the tensions or compressions between mill stands to eliminate distortions and defects in the rolled material.

The occurrence of tension in finishing mill trains has been prevented in the past by allowing the product to form a loop between mill stands by regulating the speed of each stand. The regulation of the speed of each stand is used to adjust the height of the corresponding loop between each set of stands and thus eliminate tension. This procedure, however, is not entirely satisfactory because it cannot be applied with the same success to all types of rolled product. With increasing cross section, the forming of a loop becomes impractical because the bending force becomes too large and the distance between adjacent stands required for an adequate loop is unrealistic in terms of building length and costs.

Another method of speed control of a rolling mill has been proposed where the current of the motor of a first mill stand is measured as the material first passes therethrough. This value is defined as a zero or no tension condition and is stored as a measure of the work being done on the material and serves as a reference current. The speed of the motor driving either the first or a second mill stand is then varied after the material enters the second mill stand, defined as a tension condition, until the current of the motor of the first stand is controlled to the reference current value to eliminate the tension. Because the material is subjected to a tension or compression when it is rolled between the first and second mill stands, the current difference between the no tension and tension current measurements of the first stand is proportional to the amount of speed change necessary to eliminate the condition.

When the tension between the first two stands has been minimized, a no tension ratio of the speeds between the first stand and the second stand is established. Thereafter, a no tension current for the second stand is measured as a reference prior to the material entering into a third stand. In a manner similar to the calculations for the prior two stands, the tension between the second and third stands is minimized and the no tension speed ratio for these speeds established. Because the minimization process for the second and third stands changes the speed ratio between the first and second stands from its no tension value, it is simultaneously readjusted to eliminate the tension caused. Thereafter, a successive cascading of speed control in this manner is used with tension and no tension current measurements to eliminate tension from the remaining stands of the rolling mill.

This method is a convenient low tension speed control which reduces tension between the stands and is advantageous because it does not require the measurement of actual work or torque by the motor. Direct measurement of tension and torque by load sensors, as for example shown in U.S. Pat. No. 4,089,196, is costly and requires substantial and regular maintenance. The current measurement of a motor is indicative of the torque and is relatively simple to measure with a current transducer for each motor. Further, the current of each motor can be measured to any precision necessary to be able to control the speed of the motors in a cascade control.

However, this method of low tension speed control does have some drawbacks in that the no tension and tension current measurements of the stand do not take into account other parameters which change the work the motor is doing. For example, the work done by a mill stand motor is a function of the material temperature at the time the current measurement is taken. At a set speed, the work done on a material is directly proportional to its temperature and, as a generality, will decrease as the material becomes hotter because the material elongates faster. Of course, this is a restatement of the fact that most materials are more pliable at higher temperatures. Thus, the yield stress of most materials in a rolling mill decreases as the temperature increases and, of course, the current will change proportionally because the current drawn by a motor is directly convertible into torque or work.

Since a reference or no tension current for a mill stand is measured at a different time than the tension current measurement, the reference current can be in error by an amount proportional to the temperature difference seen at the mill stand between the two measurements. These temperature differences along the profile of rolled material can be 50°–100° F. and can cause a 10–20% variation in motor current simply because of the difference. Thus, it would be advantageous to be able to use a low tension speed control using motor current measurement for tension elimination while compensating the control for temperature variation in the material being rolled.

SUMMARY OF THE INVENTION

Accordingly, it is an object of the invention to provide a method and apparatus for controlling the interstand tension of a continuous rolling mill by a successive approximation speed control.

Further, it is an object of the invention to provide a method and apparatus for controlling interstand tension of a continuous rolling mill based upon a low tension speed control which utilizes temperature compensated mill stand motor current as a parameter indicative of tension and no tension conditions.

It is yet another object of the invention to provide a method and apparatus for controlling interstand tension of a continuous rolling mill by utilizing a real time temperature profile and time reference base which associates the actual temperature of a material to the motor current measurement being made.

It is still yet another object of the invention to provide a method and apparatus for controlling interstand tension of a continuous rolling mill by utilizing a current profile and time reference base which associates the temperature effects of a material to the motor current measurement being made.

The method for controlling the speed of individual motors of mill stands in a train of a continuous rolling mill includes a measurement of the current $I_N(t1)$ drawn by the motor of stand N at time t1, where the measurement is taken after the material has entered stand N but before the nose of the material enters stand N+1. This measurement is an indication of a reference or no tension current for stand N. After the nose of the stock enters stand N+1 and the speeds and currents of stands N, N+1 have settled, but before the stock enters stand N+2, a second measurement of current $I_N(t2)$ drawn by the motor of stand N at time t2 is taken. This measurement is an indication of a value of tension current for stand N.

The difference in the currents $(I_n(t1)-I_N(t2))$ is proportional to two physical variables of the system where the first is the tension in the material between the stands N and N+1 and the second is the change in temperature of the material at stand N between times t1 and t2. A stored profile of the material temperature as a function of time and relative mill train position is used to determine the temperature, TEMP1, of the material at stand N for time t1 and the temperature, TEMP2, of the material at stand N for time t2. Because the difference between these two temperatures (TEMP1−TEMP2) causes a proportional change in the current drawn by the motor of stand N, it can be used to correct the motor current for temperature. An empirically derived proportionality constant $K_T$ which relates the physical system to a measured change in current, is used to calculate a correction factor to compensate the reference current $I_N(t1)$ for the stand N.

The compensation is accomplished by calculating a tension factor:

$$S_N=I_N(t1)-I_N(t2)+K_T(\text{TEMP1}-\text{TEMP2})\,I_N(t1) \quad (1)$$

and an individual correction multiplier:

$$ICM_N = 1 + \int K_S \frac{S_N}{I_N(t1)} \quad (2)$$

The tension factor is the absolute change in load current net of the change due to temperature variation. The tension factor is divided by the no tension current to obtain a proportional change in current and then multiplied by a scaling constant Ks. The result is used to calculate the individual correction multiplier which is used to successively modify a reference speed signal of a speed control means of stand N to null the tension factor.

Thereafter, small increment of time is used to allow the speed of the motor of stand N to settle before another current measurement $I_N(t3)$ is taken. A similar calculation for the tension factor:

$$S_N=I_N(t1)-I_N(t3)+K_T(\text{TEMP1}-\text{TEMP3})\,I_N(t1)$$

$I_N(t1)$ and the corresponding TEMP3 is used to determine a new individual correction multiplier.

Additional successive correction based on:

$$S_N=I_N(t1)-I_N(tn)+K_T(\text{TEMP1}-\text{TEMPN})\,I_N(t1) \quad (3)$$

for the tension current can then be made in this manner until just before the nose of the workpiece reaches stand N+2. At the end of this correction period, the ratio of the motor speeds of stand N and N+1 is established as the low tension speed ratio between these stands and thereafter maintained by a cascade reference speed signal generating means.

The speed of stand N+1 is then corrected utilizing the no tension current value just before the nose of the workpiece enters stand N+2, the tension current value after the workpiece enters stand N+2 but before the workpiece enters stand N+3, and the corresponding temperatures for the material at stand N+2 during the times the successive current values are measured. The correction sequence can be continued for stand N+1 until just before the nose of the workpiece enters stand N+3 to determine the no tension speed ratio between stands N+1 and N+2. This no tension speed ratio is then maintained between the two stands.

Because evaluating and setting the no tension speed ratio between stands N+1, N+2 will change the actual speed ratio between stands N and N+1 from that previously established, the reference speed generation circuit as it corrects the speed of stand N+1 to a no tension condition, cascades the speed control down to stand N such that its no tension ratio is maintained. The no tension speed ratios for subsequent stands are thereafter calculated in a similar manner and the changes cascaded throughout the previous stands to maintain those calculated ratios.

Another implementation of the control calculates the tension factor from a reference current profile. The current profile for the first mill stand is used as a tension free reference and contains information on current changes due to temperature variations in the material. The differential between the no tension reference current and the tension currents can then be corrected for temperature by a factor which relates the no tension current profile of the first stand to corresponding positions in the current profiles of other stands. The tension factor $S_N$ is calculated as:

$$S_N = I_N(t1) - I_N(t2) \times \frac{I_1(t1 - \text{OFFSET}(N))}{I_1(t2 - \text{OFFSET}(N))}$$

where OFFSET(N)=time interval between stand 1 and stand N.

These and other objects, features, and aspects of the invention will be readily apparent and more fully described upon a reading of the following detailed description in conjunction with the appended drawings wherein:

BRIEF DESCRIPTION OF THE DRAWINGS

FIG. 3 is a graphical depiction of current as a function of yield stress for a workpiece which is rolled in a mill of the type illustrated in FIG. 1;

FIG. 4 is a graphical depiction of temperature as a function of the work or elongation of a material being rolled in a mill of the type illustrated in FIG. 1 at different rolling speeds;

FIG. 5 is a graphical depiction of the surface temperature variation of a workpiece as a function of time or position of a material rolled in a rolling mill of the type illustrated in FIG. 1;

FIG. 6A is a representative graphical depiction of current as a function of time for the first mill stand in the train of the rolling mill illustrated in FIG. 1;

FIGS. 6B, 6C, and 6D are depictions of current as a function of time for the mill stands N, N+1, N+2 of the rolling mill illustrated in FIG. 1;

DETAILED DESCRIPTION OF THE PREFERRED EMBODIMENT

Figure 1:
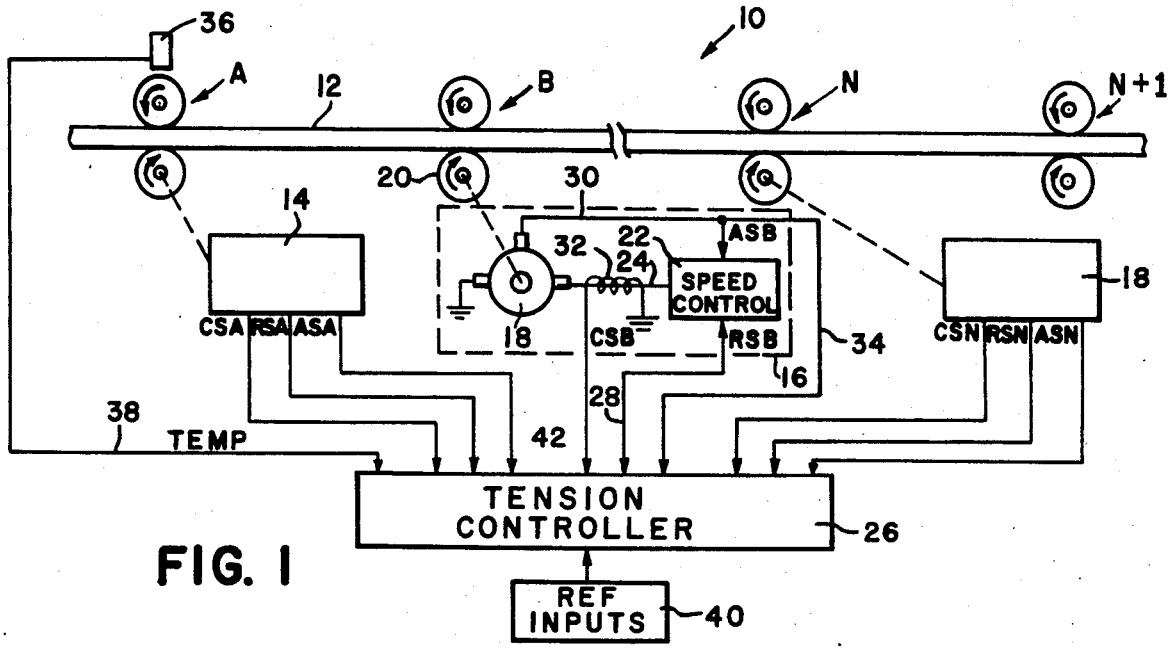
FIG. 1 is a system block diagram of a continuous rolling mill having a low tension cascade speed control by current measurement with temperature compensation which is constructed in accordance with the invention.

An apparatus for executing the method of motor speed control hereinafter described which is constructed in accordance with the invention is shown in FIG. 1. The figure illustrates a continuous rolling mill having mill stands A, B, . . . N, N+1 . . . etc. which receive a workpiece or billet 12 which is inserted into the nip between the rolls of the first stand A and thereafter successively passed through each of the other nips of the subsequent mill stands. Motor assemblies 14, 16, 18, etc., respectively, control the speed of the motors which drive the rollers of each mill stand and thereby determine the tension or compression of the material between stands.

Each motor assembly, as shown schematically in dashed outline 16, contains a motor 18 mechanically connected through gearing to its associated drive roll 20 and electrically coupled to a speed control means 22. The speed control means 22 generates an electrical output signal via line 24 which controls the angular velocity or rotation rate of the motor 18.

Each of the motors of the assemblies 14, 16, 18, . . . etc. are controlled by a tension controller 26 to minimize tension and compression of the workpiece 12 between each of the stands A, B, . . . N, N+1, . . . etc. The tension controller 26 generates a reference speed signal RSB, for example on line 28, which is input to the speed control 22 and which is compared to an actual speed signal ASB on line 30. The signal ASB is a measure of the actual speed of motor 18 and can be generated from any type of speed transducer including a tachometer. In a conventional manner, the speed control 22 compares the reference speed signal RSB and the actual speed signal ASB in order to generate the control signal on line 24 in a manner which reduces or nulls the difference. The speed control 22 is preferably a closed loop speed controller and can be embodied by proportional, integral, or derivative controls or combinations thereof. This type of speed control maintains the speed of the motor 18 at a rotation rate equal to the input signal RSB on the reference speed control line 28.

When the speed control 22 has minimized the difference between the actual speed signal ASB and the reference speed signal RSB, the current drawn by the motor 18 via control line 24 will be indicative of the work or torque output from the motor. This work is a measure of the amount of energy being used to form the workpiece or billet 12. The value of the current drawn by motor 18 can be sensed conventionally by a current sensor 32. The sensor 32 generates an actual current signal CSB on line 42 which is indicative of the actual current drawn by the motor 18. Thus, as the load on the mill stand B changes either due to the work being done on workpiece 12, the temperature of the workpiece 12, or the tension or the compression between stands B and, A or N, the motor current will change accordingly and be sensed by the transducer 32. The current signal CSB is input to the tension controller 26 as a measure of these changes along with actual current signals CSA, . . . CSN, . . . etc. from all of the other mill stands 14, . . . 18 . . . etc. Additionally, the actual speed signals, ASA, ASB, ASN, . . . etc. are also input to the tension controller 26.

The tension controller 26 also receives a signal TEMP indicative of the actual temperature of the surface of the workpiece 12 via line 38. The signal TEMP is generated by a temperature sensor 36. In the preferred embodiment, the temperature sensor 36 is placed at or after the nip of the initial mill stand A in the train and its position serves as a reference for the interstand tension control 26 as will be more fully described hereinafter. The temperature sensor 36 can be a surface pyrometer which is commercially available and outputs an electrical signal representative of surface temperatures of the billet 12.

The tension controller 26 from the inputs from the temperature sensor 36, the actual speed signals ASA-,ASB . . . ,ASN,ASN+1 . . . , and the current signals CSA,CSB, . . . ,CSN,CSN+1 . . . , generates the reference speed signals RSA, RSB, . . . ,RSN,RSN+1, . . . to control the mill stand speeds in a manner to minimize the interstand tensions between successive stands. The tension controller 26 will also include a means for reading in reference speed inputs 40 for presetting the references speed signals to set up values which are relatively close to what is finally desired.

When preset speeds are used the tension controller 26 may do the fine tuning necessary to minimize the tension between stands and does not have to initially act as a speed controller to bring each stand up to a relatively high speed prior to the insertion of the workpiece 12 in the nip between the drive roller and the idler roller. While the preferred embodiment of the system has been illustrated, it is evident that mill stands having both rollers driven and mill stands which are variable in rolling force could also be used. The gap between rolls of the mill stands can also be variable with respect to settings (not shown) as is known in the art. In roughing mill trains, the number of mill stands is of the order of between 8–12 while for finishing mill trains the number can vary from 6–15.

Figure 2:
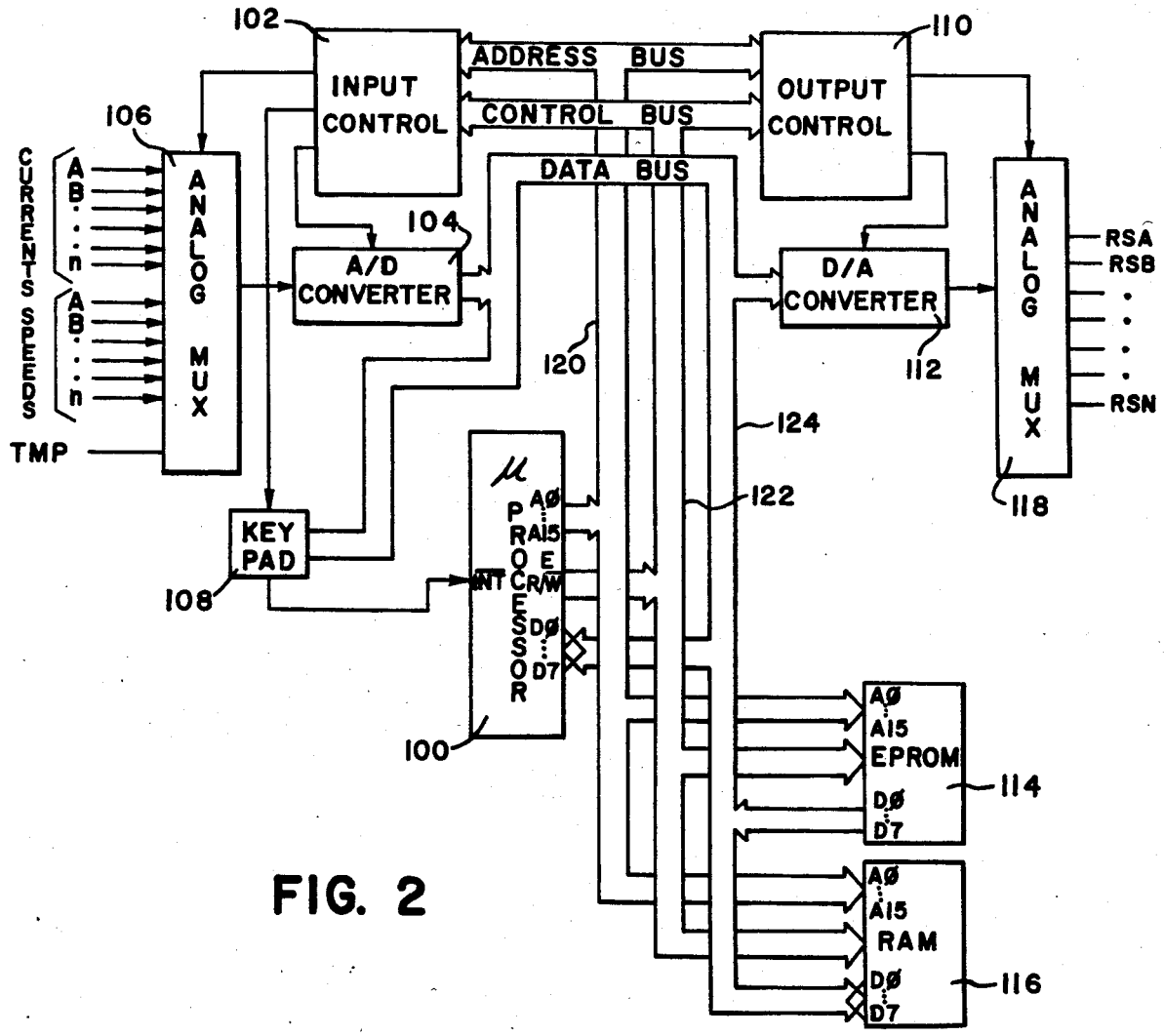
FIG. 2 is an electrical schematic block diagram of the hardware circuitry implementing the tension controller illustrated in FIG. 1.

A hardware implementation of the tension control 26 illustrated in FIG. 1 will now be more fully described with reference to FIG. 2. The tension controller 26 is implemented as a microprocessor based control with a programmable microprocessor 100 performing input, output, and control functions for the controller. The microprocessor 100 is a commercially available sequenced machine which runs under program control of system software stored in an EPROM 114 connected to the data, control, and address buses 120, 122, and 124 of the microprocessor 100. Further, the tension controller 126 has a random access memory or RAM 116 for storing constants and variables used in the calculation process, and as a data scratch pad for temporary or intermediate storage. The RAM 116 also communicates with the microprocessor 100 over the address, control, and data buses 120, 122, and 124; respectively.

The microprocessor 100 inputs data from the rolling mill by controlling an input control 102 to read or measure the currents, and speeds from the motor assemblies 14, 16, . . . 18, etc. and the temperature from pyrometer 36. Further, the input control 102 has means for converting operator input from a keypad 108 into digital data which can be read by the microprocessor 100 via the data bus 124. The input control 102, under regulation of the microprocessor 100, inputs each individual current and actual speed from the motor assemblies 14, 16, . . . 18, . . . etc. via an analog multiplexer 106 and an A/D converter 104. The output of the A/D converter 104 is connected directly to the data bus 124 of the microprocessor 100 and converts each of the measured input parameters into a digital number upon command from the input control 102.

The digital numbers are input in a set sequence by scanning the input ports of the analog multiplexer 106 with strobes from the input control 102. In this manner, the microprocessor 100 receives digital representations or values for the currents A,B . . . ,N, . . . , etc. the actual motor speeds A,B, . . . N, . . . , etc. and the temperature TEMP at predetermined intervals. Preferably, a timer or scanner routine is used to scan each input every 100 milliseconds. A temporary buffer of the parameter values is then stored and overlaid with the next parameter values if not put into semi-permanent or intermediate storage before the next set of parameter values are input.

The keypad 108 is connected directly to the data bus 124 of the microprocessor 100 and operates on an interrupt basis under control of a keyboard handling routine which conventionally inputs selected keys in a temporary buffer and decodes the inputs as commands and responses to system conditions. The keypad 118 is used for initiating the system routine for the tension controller 26 and for inputting the preset speeds for each stand. Further, the keypad 108 is used for special control functions such as stop, start, terminate control, etc.

The microprocessor 100 uses the currents, speeds, and temperature signal to calculate the reference speed signals as previously described and employs an output control 110 to steer the correct reference speed signal to its corresponding motor assembly. The reference speed signals are sequentially output on data bus 124 to a D/A converter 112 where they are converted into corresponding analog values. The correct analog value is multiplexed to the associated motor assembly via multiplexer 118 operating under the control of the output control 110. Each analog reference speed signal is maintained at the outputs of multiplexer 118 for enough time for the speed control of a motor assembly to sample and hold the analog signal to determine the correct reference speed.

In general the tension controller 26 measures a no tension current $I_N(t1)$ and a plurality of tension currents $I_N(t2)$, $I_N(t3)$ . . . , etc. of a stand N and forms differences between the no tension current and each tension current. Each difference, which is proportional to the tension between two stands N, N+1 in the train and the material temperature when the current measurements were made, is used to calculate an incremental correction to control the ratio of the speeds of the stands toward a no tension value. The no tension ratio is reached when, after correction for temperature, the no tension current is equal to the tension current, i.e., their difference is zero, or the correction interval has expired.

The incremental correction is accomplished by taking a proportional part of a difference correction factor $S_N$ and controlling the speed of a reference stand with the proportional part in a direction to null the difference. Preferably, the proportional part can be some fraction, for example one half of the speed difference corresponding to the current difference $S_N$. The next incremental calculation of $S_N$ is indicative of the correction obtained and, if zero, the balancing of the speed ratio between two stands for a no tension condition has been accomplished. If not zero, then $S_N$ is calculated once again and another correction applied until the resulting difference is either driven to zero or the correction period expires.

The temperature compensation is to ensure that a current difference correction $(I_N(t1)-I_N(t2))$ is due to tension between stands and not due to a change in temperature, and thus, the work done by a stand between the times the first current measurement was made and the second current measurement was made. The correction factor $S_N$ is compensated for temperature by taking the difference between the temperatures (TEMP1−TEMP2) of the material at stand N for the times the current measurements were made. This difference is proportional to the change in motor current at stand N due only to temperature change in the material. Each physical plant will have an empirical constant $K_T$ associated with it which will determine the change in motor current with a change in material temperature. Thus, a compensation factor:

$$K_T(TEMP1-TEMP2)I_N(t1) \quad (4)$$

can be combined with the current difference ($I_N(t1)-I_N(t2)$) to form the correction factor $S_N$.

In determining an empirical constant for correcting the differential current for temperature, a convenient way of approaching the problem is to determine for a particular system how current for a rolling mill stand will change with respect to the yield stress of the material rolled. A graphical representation of such a relationship is shown in FIG. 3 where it is seen that yield stress is a relatively well behaved function of current, with few if any discontinuities, and having a relatively smooth and constant slope.

The reason for the shape of this curve, as is illustrated in FIG. 4, is that the work done by a rolling mill stand varies as a function of temperature at individual mill stand speeds S1, S2, and S3. By knowing the approximate roll speed, the material, and its elongation constant, it is possible to determine the change in current for a change in temperature by combining FIGS. 3 and 4 to produce a slope approximation and thus an empirical constant $K_T$ for Equation 4.

A typical temperature profile for a workpiece along its surface is illustrated in FIG. 5 where the abscissa is position or time and the ordinate axis describes temperature in Fahrenheit degrees. It is seen that for a slab or billet from a pusher type furnace that the surface temperature profile may change relatively rapidly from about 1850° F. to about 1950° F. over short lengths. This temperature variation because of the principles discussed in the relationships of FIGS. 3 and 4 make a current calculation based only on a change of tension inaccurate and relatively difficult from which to control speed. A 50°–100° F. change over the length of the workpiece can cause current variations of approximately 10–20% without any real change in tension. Therefore, controlling on apparent tension current without compensation for temperature may cause even a greater tension or compression between mill stands then if no correction at all were applied.

Figure 7:
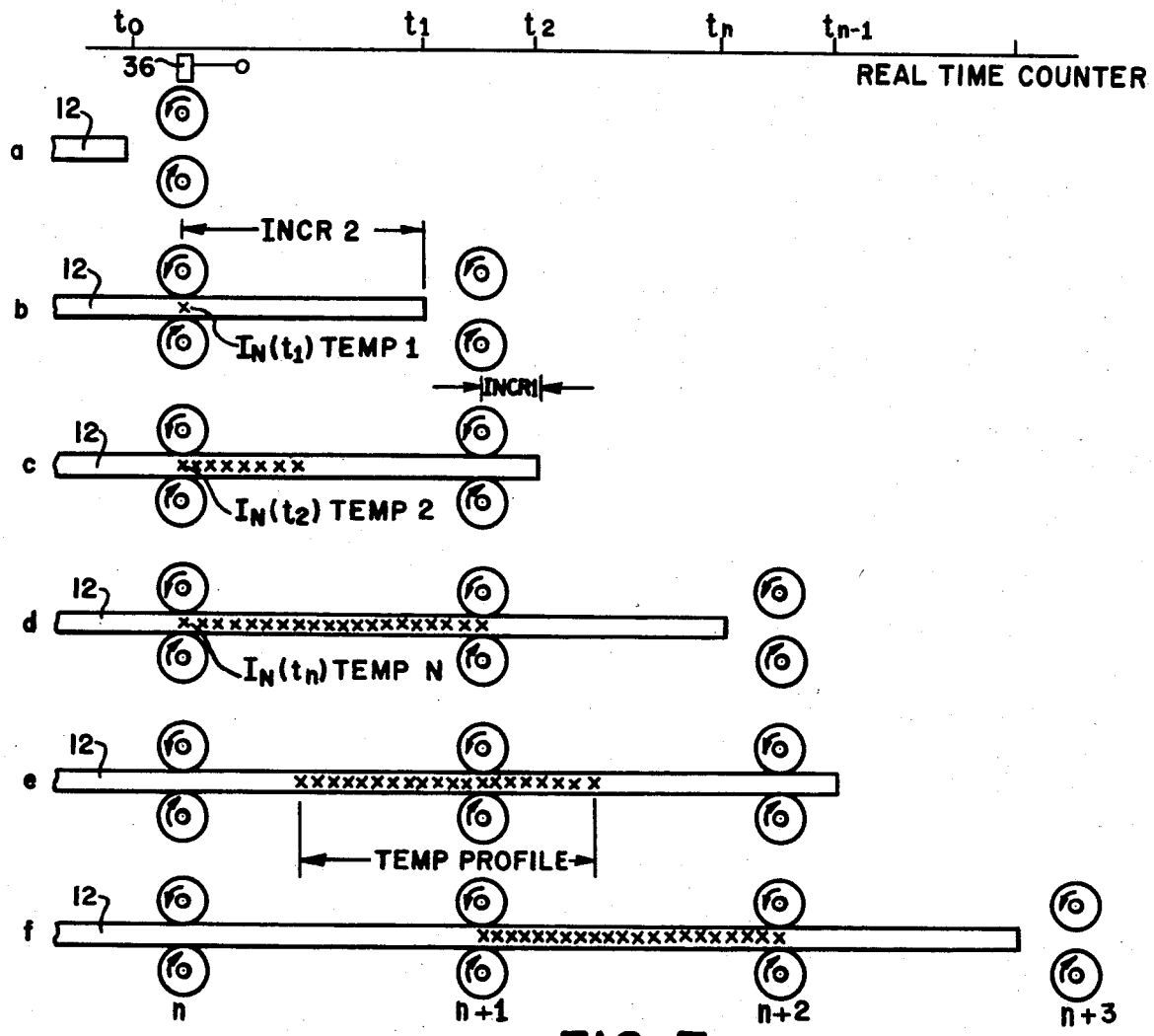
FIGS. 7A, 7B, 7C, 7D, 7E, and 7F are pictorial representations and timing diagrams of the measurement and storage of temperature and current parameters during operation of the rolling mill illustrated in FIG. 1.

With respect now to FIGS. 6, 7, and 8, the method of operation for the invention will be more fully explained. The method comprises controlling the speed of each mill stand motor of a train in succession while the billet is first entering the stands. In this manner, no tension speed ratios for each pair of stands can be generated before the material is tensioned by the next stand. These no tension or low tension ratios are maintained by a cascade control where, when a subsequent mill stand speed is modified, the change ripples through the control to maintain the previously set speed ratios. At the time the nose of the billet reaches the end of the train, the no tension speed ratios have been set for all the stands and control is maintained on those ratios for the remaining portion of the run.

Figure 8A:
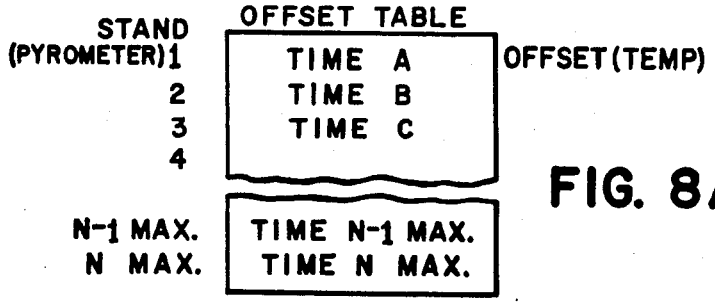
FIGS. 8A, 8B, and 8C are pictorial representations of parameter storage tables for the time, current, and temperature values used by the tension controller illustrated in FIG. 1.
Figure 8B:
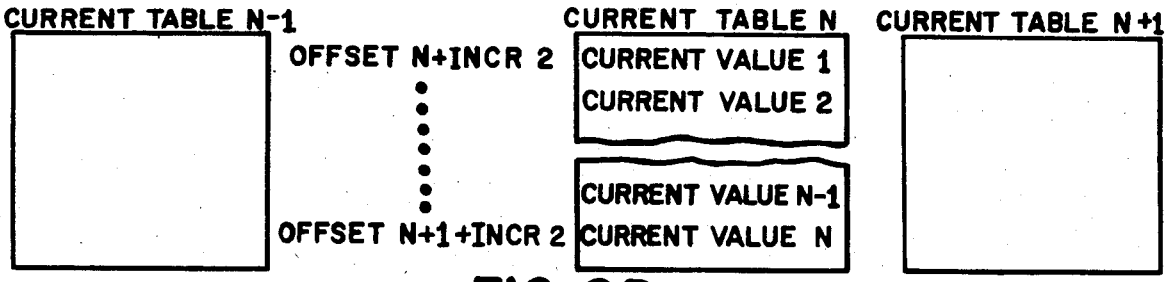
Figure 8C:
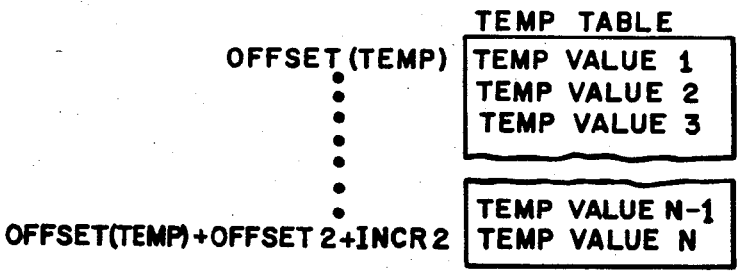

FIG. 6A, B, C and D illustrate graphical depictions or the currents drawn by the motors of mill stands 1, N, N+1, N+2, respectively. The current of the Nth stand is In and is graphed as a function of time in FIG. 6B with the corresponding surface temperature of the material inserted at particular times. The surface temperatures and associated locations of the billet are those shown correspondingly in FIG. 5. FIGS. 7A–F are pictorial representations of the workpiece separately entering the nips of the rollers of the rolling mill 10 as a function of time. FIGS. 8A–C illustrate tables forming profiles of particular parameters stored by the system which are used in the tension control and temperature compensation operations.

With reference now to FIG. 7A, prior to time zero, or t0, the workpiece 12 is being transported to the rolling mill 10, preferably directly from a pusher furnace or the like, and the original set up speeds of the rolling mill have been input to the control. Each of the rolling stands is being controlled by the tension Controller 26 at its predetermined speed. The current and speed of each motor and the temperature from the pyrometer are being scanned at a fixed interval, preferably every 100 millisecs.

Current $I_1(t)$ in FIG. 6A is thus a relatively low value since the motor for stand 1 is not performing work on the workpiece 12 and, therefore, is not under load. As the workpiece 12 enters stand 1 at time t0, a counter is started and maintains a real time base for travel of the workpiece through the rolling mill 10. The time t0 is identified by a significant change in the motor current of stand 1 from a base current as the billet enters it. The current $I_N$ of the motor of the stand N is still a relatively low value as the nip of stand N has not been entered.

When the workpiece 12 enters the nip of mill stand N, the current drawn by the motor or the stand increases substantially as the rollers begin to shape and form the workpiece and thereby are required to produce an increase in work from the motor. The entry into the nip of stand N is recorded by noting the time OFFSET(N) when the current of stand N exceeds an idling or base current value. OFFSET(N) is the time elapsed between the billet entry into stand 1 and its entry into stand N. The entry into each nip can be recorded similarly and forms a table of offset times for every stand as shown in FIG. 8A.

In addition, each stand N has a current profile stored for it as shown in FIG. 8B. The current values stored for each stand are referenced to a beginning and ending time divided by the equal increments of the real time clock. The current values for each particular stand N, as will be more fully explained hereinafter, are recorded at regular intervals from a time just before the entry of the billet into stand N+1 to a time just before the entry or the billet into stand N+2.

Similarly, the time offset OFFSET(TEMP) between the arrival of the billet at stand 1 and the arrival of the billet at the pyrometer 36 is recorded when a significant rise in temperature indicates the leading end of the billet has reached the pyrometer. The system also stores a temperature profile or the surface of the workpiece as it travels along the rolling mill. This temperature profile is illustrated graphically in FIG. 5 and as a table representation in FIG. 8C. The surface temperatures at stand 1 are recorded until a temperature profile, which will be used for all the stand pairs, is generated having sufficient information. In the preferred embodiment, this would include recording temperatures until just before the entry of the billet into the third stand. The portion of the profile used for compensation is shown blocked out by x's in FIGS. 7A–F as it moves through the mill stand train.

As the workpiece passes through the mill, it is being elongated, its cross-section is being reduced and its speed and length are increasing proportionately. However, since the rate of mass flow is essentially consrant throughout the mill, measurements made at different points in the mill are related if each measurement at a given point is made at the same time relative to the arrival of the workpiece at that point. In particular, the temperature profile in time shown in FIG. 5 would show the same relative temperature distribution at any point in the mill.

It is evident that by using the time base maintained by the real time counter, the offset times, and the time related values of the tables shown in FIGS. 8A–8C, a correlation between a current value at a particular time and stand and the temperature of the material at that time and stand can be established. By being able to use corresponding values of current and material temperature, the temperature compensation carried out by the invention is greatly facilitated.

When the workpiece almost reaches the entry point for stand N+1, at time t1 in FIGS. 6 and 7B, the current $I_N$(t1) drawn by the motor of stand N is measured. Further, the temperature TEMP1 of the workpiece at stand N is additionally available from the stored temperature profile. This is an indication of a no tension or reference current for stand N because the next stand N+1 is not yet pulling or pushing the material. After the workpiece passes through the nip of the mill stand N+1 at time t2, a current $I_N$(t2) is measured for the stand N and the temperature TEMP2 of the surface of the workpiece at stand N is also taken from the stored temperature profile as shown in FIG. 7C. The two current measurements $I_N$(t1) and $I_N$(t2), taken at times t1, t2 are separated in time by the interval it takes the workpiece to enter the nip of stand N+1 and the current $I_N$ to settle as the stand N+1 adjusts for the load of the workpiece. In units of the real time clock, t1 occurs at OFFSET(N)+INCR2 while t2 occurs at OFFSET(N+1)+INCR1. INCR1, INCR2, t1, t2, t3 will be different for each stand N, and can be calculated with sufficient accuracy from the known drive motor speeds, gearing ratios, roll diameters, and the distances between stands. The increments are preferably set so that t1 occurs about 18" before entry of the billet into a nip and t2 occurs about 18" after it leaves a nip which allows time for the current to settle and tension to build up between stands.

It is seen in FIG. 6C, the measured current $I_N$(t2) is less then the measured current $I_N$(t1) indicating that the mill stand N+1 is pulling or tensioning the material from stand N. This causes a decrease in the load on stand N and a subsequent drop in the torque and/or current needed to work the piece. However, it is not evident how great the tension current is because the difference $I_N$(t1)−$I_N$(t2)) is proportional to not only the tensioning current, but also the change in temperature on the surface of the workpiece between the time of the current measurements. The temperature has changed from 1860° F. at time t1 to 1900° F. at time t2. Thus, it is evident that not all of the current decrease from $I_N$(t1) to $I_N$(t2) was due to tension placed on the workpiece by stand N+1 but is also due to the decreased work required to form the material at the higher temperature. The compensation factor is combined with the current difference as previously explained and the result used as the correction factor.

After the correction, the current in stand N is allowed to settle during a delay time. The proportional correction will be in a direction to increase the current $I_N$ to take up the increased load necessary to eliminate the tension between the mill stands N, N+1. Another measurement is taken at the time t3 to determine if the no tension current measured at t1 has been attained by the correction. However, because the temperature at stand N at time t3 is different than the temperature at stand N at t1, or at time t2, an additional calculation of the compensation factor has to be accomplished to determine how much of the correction was due to the reduction of the tension current rather than the increase or decrease in the surface temperature of the workpiece.

It is seen at time t3 that the current $I_N$(t3) in stand N increased and, therefore, it appears that the correction is working in the right direction towards the reference current $I_N$(t1). However, because the temperature at t3 also increased to 1940° F., it is unclear how much additional correction is required to reduce the tension current to zero. In our example, for the correction attempted, a much greater result would have been obtained had not the temperature increased and reduced the current due to the reduction in energy needed to form the workpiece 12.

This correction process for the speed of stand N can be continued for a predetermined correction interval until just before the workpiece enters the mill stand N+2 at OFFSET(N+1)+INCR2(N+1) to begin another cycle. The temperature profile which has been stored for the workpiece during progression through the first two mill stands can be used in the process for successive pairs of stands in the system. Each new pair of stands sees the same temperature variation on the surface of the material when the no tension and tension currents are measured by keeping track of this profile as a function of time.

Figure 8D:
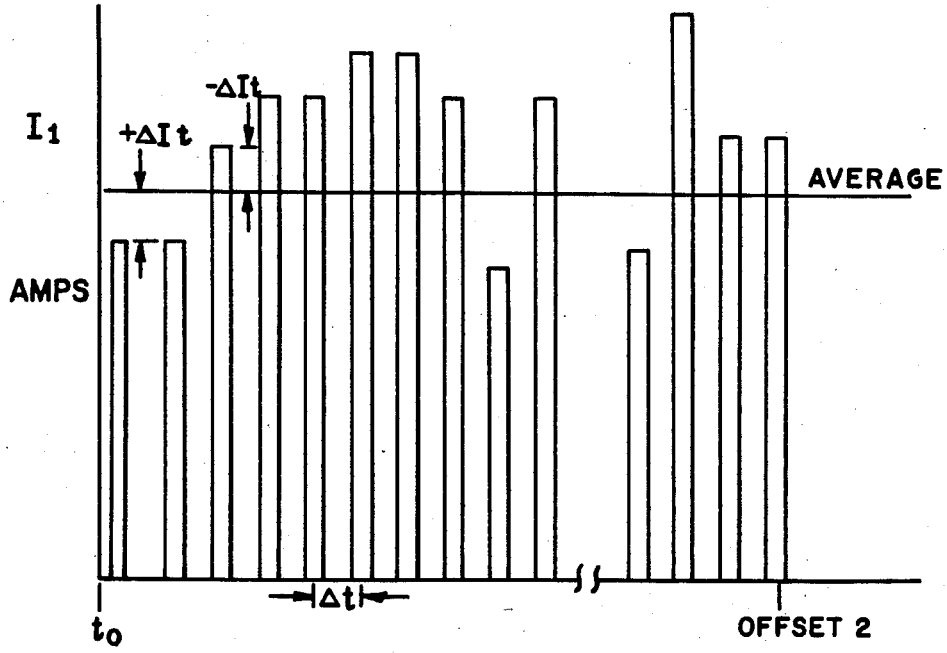
FIGS. 8D is a graphical representation of a current reference profile as a function of time which is used for temperature compensation in a second embodiment of the invention.

Another method will now be explained with reference to FIG. 8D for correcting the current differences $I_N$(t1), $I_N$(t2) with temperature compensation when conditions make it undesirable to use a pyrometer. FIG. 8D shows the values of the current profile of mill stand 1 from the time the billet enters stand 1 until just before it enters stand 2. During this interval, the material is being worked only by stand 1 in an inherently tension free mode. Any variation in current may be assumed to be caused by factors other than tension, chiefly by temperature variation in the material being rolled. The current profile during this interval is stored and used as a reference indication of temperature effects in compensating the currents $I_N$(t1) and $I_N$(t2) at corresponding times relative to the arrival of the billet at subsequent stands N. This method does not allow for an automatic speed correction at stand 1 itself, so this must be done manually.

In this method, equations 1 and 2 take the form:

$$S_N = I_N(t1) - I_N(t2) \times \frac{I_1(t1 - \text{OFFSET}(N))}{I_1(t2 - \text{OFFSET}(N))} \tag{6}$$

$$ICM_N = 1 + \int K_S \frac{S_N}{I_N(t2)} \tag{7}$$

A more detailed functional block diagram of the tension controller 26 illustrated in FIG. 1 will now be described with reference to FIG. 9. The tension controller 26 is formed of a plurality of reference speed signal generator modules 212, 214, 216, . . . and 218. The reference speed generator modules generate the speed reference signals RSA, RSB . . . RSN, RSN+1 from a number of different inputs. Initially, the reference speed signals are generated from the preset speeds input by the operator during the setup mode. The preset speeds are transmitted to the reference speed generators via data line 220 from a constants and preset speeds memory 204.

In general, the reference speed signal of a reference speed generator is the preset speed modified by an associates signal from a correction signal generator 206 during a tension reduction routine for the system. The correction signal generator 206 generates a correction signal to each of the reference speed generators through a multiplexer 210 whose output selection is controlled by a control and timing circuit 208. The correction signal generator 206 uses data stored in a temperature memory 200, and a current memory 202 to successively approximate the tension current between two stands and applies an incremental correction signal through the MUX 210 to a selected reference speed signal generator. Once a particular mill stand has been corrected for tension between it and the next stand, the correction signal generator is indexed to the next reference speed generator and different temperature and current data used from memories 200 and 202 to correct the next reference speed signal.

Each of the reference speed signals is corrected from its original preset value to reduce tension between adjacent stands and once a low tension condition is determined, a speed ratio between the particular stand and its subsequent stand is established. This ratio is maintained thereafter by making all corrections in a cascade mode such that when a correction is made to stand N speed, the same proportional correction is made to all stands N-1, N-2, . . . , 1 upstream.

Figure 10A:
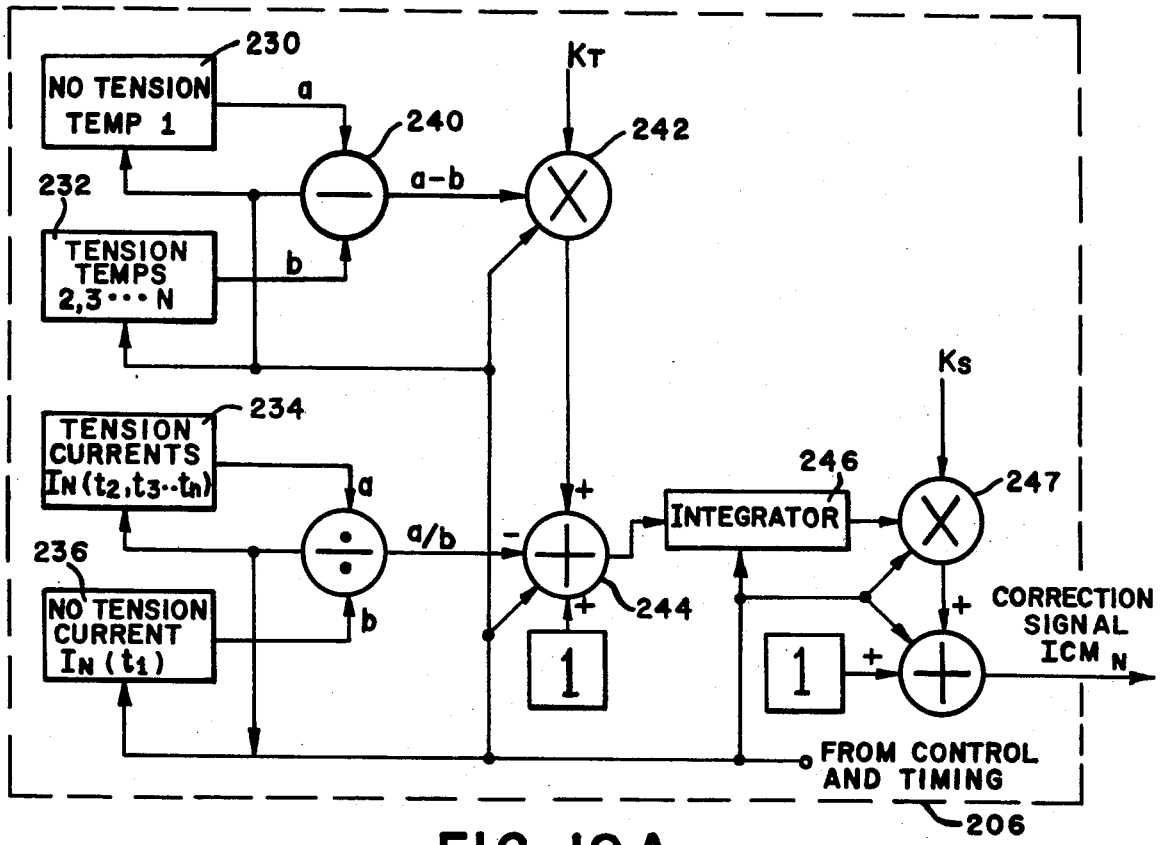
FIG. 10A is a functional block diagram of one implementation of the correction signal generator illustrated in FIG. 8.

A more detailed functional block diagram of the correction signal generator 206 is illustrated in FIG. 10A. The correction signal generator 206 implements Equations 1 and 2 combined in the form:

$$ICM_N = 1 + K_s \int \left[ 1 - \frac{I_N(t2)}{I_N(t1)} + K_T(\text{TEMP1} - \text{TEMP2}) \right] \quad (8)$$

The functions illustrated in FIG. 10A which implement this include a divider 238 which takes the ratio of a tension current 236 to a no tension current value 234. The output of the divider 235 is used as one input to a summing junction 244. Additionally, a subtracter 240 differences a no tension temperature value 230 with a tension temperature value 232 and outputs the result to a multiplier 242. The output of the multiplier 242 is the product of the result from the subtracter 240 and the empirical constant $K_T$. The resulting product is received at summing junction 244 along with the output of divider 238 and a constant 1. The output of the summing junction 244 is a proportional incremental change in tension and is received by an integrator 246. All incremental changes are summed in the integrator 246 and multiplied by constant $K_S$ in multiplier 247. A constant 1 is added to the result in summing junction 248.

The current values 234 and 236 are the no tension current value $I_N$(t1) measured at a particular stand N and the tension current value $I_N$(t2) measured at stand N after the material enters the subsequent mill stand N+1. The temperature values 230 and 232 correspond to the surface temperature of the material at the particular stand N where the currents $I_N$(t1), $I_N$(t2) are measured. It is seen that the function blocks 230–248 implement Equation 8 and output an incremental correction signal $ICM_N$ to a reference speed generation circuit.

The integrator 246 depending upon the polarity and amplitude of the output from summing junction 244 produces an incremental correction signal that is used to modify the preset speed reference values. The integrator 246 allows a successive approximation control to correct the tension current produced by the speed mismatch between two adjacent mill stands. The integrator 246 will hold incremental changes caused by differences produced at the output of the junction 244 and after a delay for allowing the speed of the stand N to settle, will add or subtract another increment depending upon the polarity and amplitude of the output of the summing junction 244.

The sum of increments in integrator 246 is received at multiplier 247 where it is multiplied with scaling factor $K_s$ to give the total proportional incremental change to be made to the reference speed of stand N and null the accumulated proportional tension measurements. Finally, the output of multiplier 247 is received at summing junction 248 where it is added to the constant 1. The result is a multiplication factor which when multiplied by the stand preset reference speed will cause the appropriate incremental change in speed at stand N to lower tension.

It is seen that a correction signal for each of the speed reference generation circuits can be provided in the manner as hereinbefore described by choosing the correct times for the measurement of the currents and matching them to the temperatures on the surface of the billet at the corresponding locations of the mill stands.

Figure 10B:
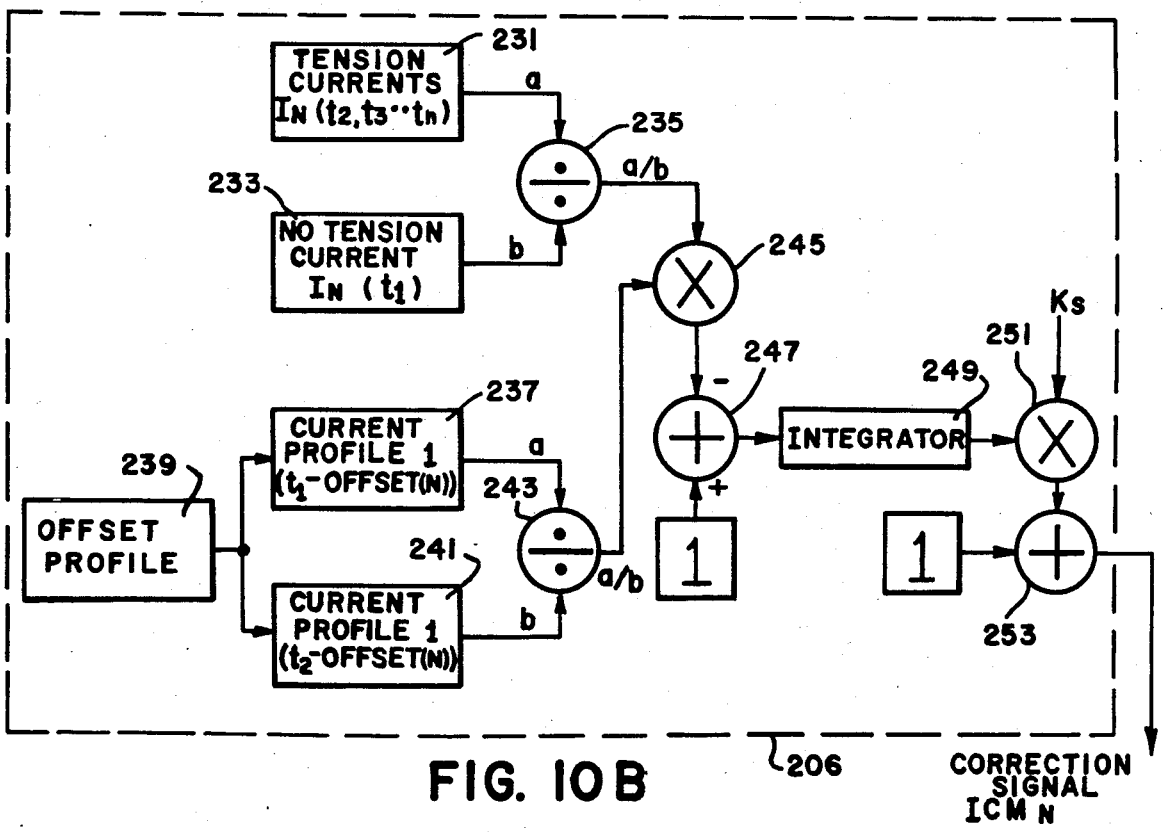
FIG. 10B is a functional block diagram of a second implementation of the correction signal generator illustrated in FIG. 8.

A more detailed functional block diagram of the alternative implementation of the correction signal generator 206 is illustrated in FIG. 10B. The correction signal generator of this figure implements equations 6 and 7 combined in the form:

$$ICM_N = 1 + K_S \int \left[ 1 - \frac{I_N(t2)}{I_N(t1)} \times \frac{I_1(t1 - \text{OFFSET}(N))}{I_1(t2 - \text{OFFSET}(N))} \right] \quad (9)$$

The functional block diagram in FIG. 10B illustrates a multiplier 245 which provides the product of two ratios from dividers 235,243. Divider 235 outputs the ratio of the tension currents $I_N$(t2,t3 . . . tn) and the no tension current $I_N$(t1). Divider 243 outputs the ratio of the current value of the profile for stand 1 corresponding to $I_N$(t1) and the current values of the profile for stand 1 corresponding to $I_N$(t2,t3 . . . tn). These values are calculated by using the offset time value OFFSET(N). The resulting product from multiplier 245 is subtracted from the constant 1 in adder 247 before being integrated in integrator 249.

The output of the adder 247 is a proportional incremental charge in tension. The sum of these incremental corrections made during the corrections time is output from the integrator 249 and received at a multiplier 251. The sum is multiplied by a scaling $K_S$ to give the total proportional incremental change to be made to the reference speed of stand N to null the accumulated proportional tension measurements. The output of the multiplier 249 is received at a summing junction 253 where it is added to the constant 1. The result is a multiplication factor which when multiplied by the stand preset reference speed will cause the appropriate incremental change in speed at stand N.

Figure 11:
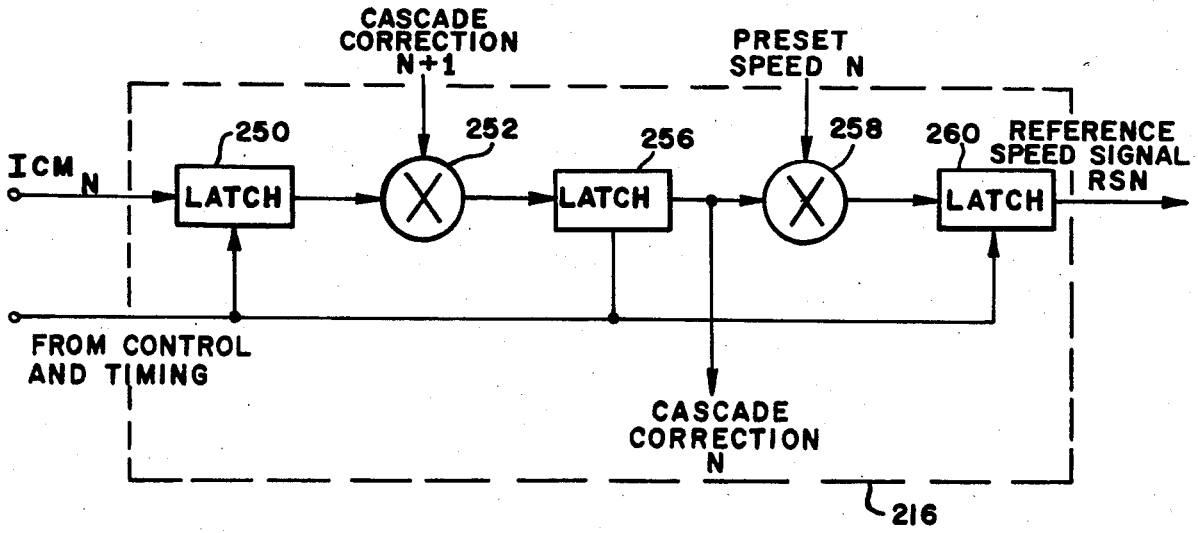
FIG. 11 is a detailed functional block diagram of one of the reference speed signal generating means illustrated in FIG. 8.

The functional block diagram in FIG. 11 illustrates one of the speed reference signal generators N where all other generators are similar. The function of the speed reference signal generator is to produce a digital speed reference signal which is indicative of the desired speed of an individual stand motor. Initially, the stand motor reference speed signal RSN will be equivalent to the preset speed which is input during a setup or initialization process. Next, the speed will be corrected by the individual correction signal to match the speed of the particular stand in question to the subsequent stand to eliminate tension. After the no tension condition is attained, a ratio of the speeds of the two stands will be established. Thereafter, the control will calculate no tension reference speeds for the subsequent mill stand pairs and cascade the control down the train to be able to maintain each no tension ratio at a constant.

In view of these foregoing operations, a latch 250 receives the individual correction multiplier $ICM_N$ associated with the stand N from correction signal generator 206. The latch 250 is enabled and controlled by the control and timing circuit 208 in FIG. 11. The output of latch 250 is received at an input of multiplier 252, which also receives as an input the cascade correction multiplication factor associated with stand N+1 from the reference speed signal generator for stand N+1. The output of latch 256 is the total correction multiplier associated with stand N comprising the product of the individual correction multiplier $ICM_N$ tending to null the tension between stands N and N+1 and the cascade correction multiplier associated with stand N+1. The output of latch 256 further transmitted to the reference speed signal generator associated with stand N-1 and is also received by a multiplier 258. The multiplier 258 also receives the preset speed reference of stand N which is input during setup or initialization. The product from junction 258 is received at latch 260 whose output is the speed reference signal RSN.

In operation, during initialization the motor of stand N is generally started and controlled at the preset speed Np by enabling the latch 250, 256 and 260 and setting the individual correction multiplier $ICM_N$ and cascade correction multiplier N+1 each initially equal to unity. The result is a value equal to the preset speed Np available from memory 204. The motor of stand N operates at the preset speed until the control has successively stepped through previous pairs of stands for tension correction and is now addressing the particular stand N. At this time, the correction signal generator 206 for stand N will begin to produce successive approximations for the individual correction multiplier $ICM_N$. After each approximation, the new value is latched in latch 250, and multiplier 252 and latch 256 are enabled. At this time, the cascade correction multiplier N+1 will still be unity, so latch 256 will contain the individual correction multiplier. This value is then multiplied in multiplier 258 by the preset value and latched in latch 260 to produce a new speed reference signal RSN.

The output of latch 256 is also received by the reference speed signal generator of stand N-1 where it has the effect of modifying the speed reference for stand N-1 in the same proportion as the speed reference for stand N, thus maintaining the speed ratio between stands N and N-1 at the value previously established. At the end of the correction interval for stand N, the correction signal generator 206 associated with stand N ceases updating the individual correction multiplier $ICM_N$ which remains unchanged in latch 250 until a new billet begins the next correction cycle for stand N.

After the end of the correction interval for stand N, a low tension speed ratio will have been established between stands N and N+1. This ratio is maintained thereafter by enabling latches 256, 260 whenever any of the cascade correction multipliers for stands N+1, N+2 . . . $N_{MAX}$ are modified, thus modifying the speed reference for stand N in the same proportion as the speed reference for stand N+1.

Figure 9:
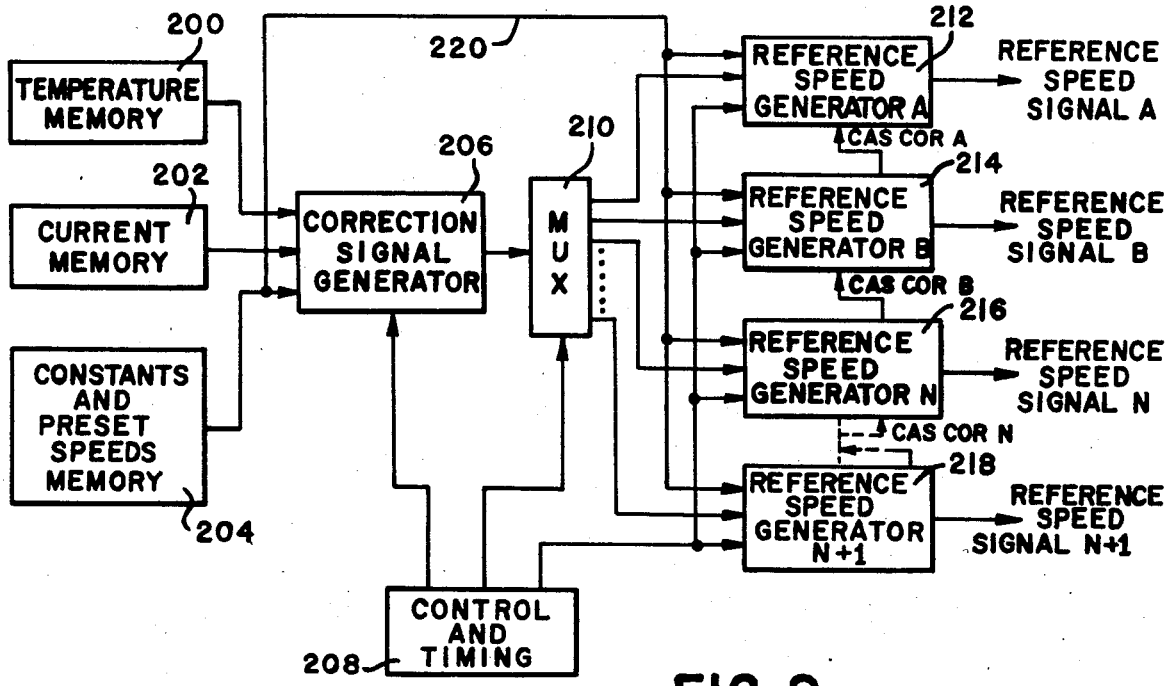
FIG. 9 is a generalized functional block diagram of the tension controller illustrated in FIG. 1.

FIGS. 9, 10, and 11 illustrate functional block diagrams of the system and could as easily be implemented either by circuitry or software. As indicated with respect to FIG. 2, the preferred embodiment of the invention is a software based microprocessor system and FIGS. 12–16 will now be used to refer to flow charts implementing the invention in this form.

Figure 12:
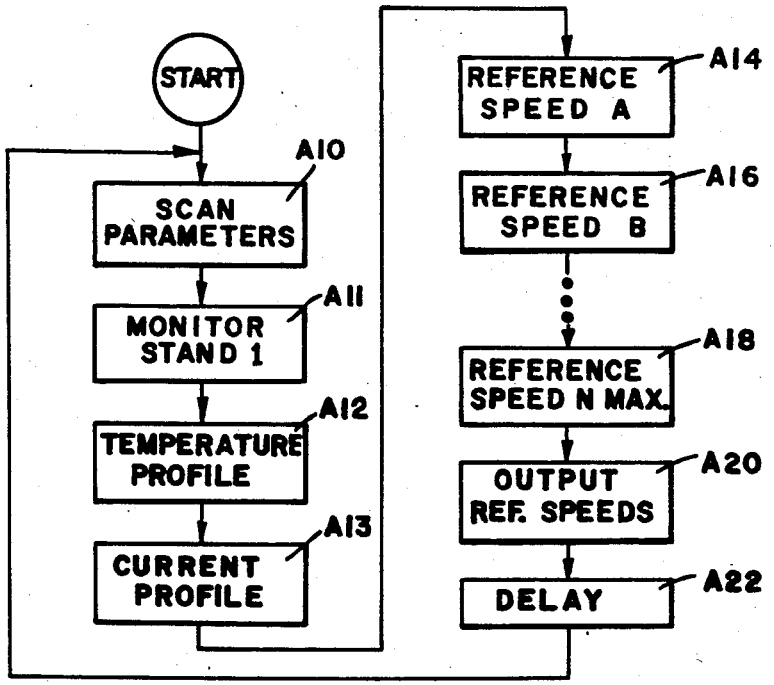
FIG. 12 is a system flow chart of the main program controlling the microprocessor 100 illustrated in FIG. 2.

FIG. 12 is a system flow chart of the sequential operations of the main program stored in the EPROM 14 of the system. After initializing constants and handling basic configuration control, the main program will begin at block A10 and thereafter loop through blocks A10–A22 every 100 millisecond to provide the speed control in the manner previously described. In block A10 the routine for inputting the values of the parameters is illustrated. The currents, speeds, and the temperature are read at the beginning of every 100 millisecond time slot and stored in an intermediate memory for further use. After block A10 has been executed, a routine to monitor motor current at stand 1 represented by block A12 is initiated. The stand 1 monitor routine begins and ends the correction cycle for each billet entering the mill, and enables the succeeding profile storage routines A12 and A13. The profile storage routines are used to store particular values of the time, temperature, and currents to the tables illustrated in FIGS. 8A–8C.

Thereafter, a series of reference speed calculation blocks A16 . . . A18 are used to calculate each reference speed signal where each stand N has a corresponding routine block. After all the reference speed signals have been calculated, an output routine illustrated in block A20 controls the output control 110, D/A converter 112, and analog multiplexer 118 to output the speed reference signals to the various speed controls. After the reference speed signals have been output, the program delays in block A22 until the end of the time slot before it begins a new cycle by looping back to block A10. In this manner, the values of the parameters for each stand and the reference speeds for each stand are updated on a real time basis every 100 milliseconds.

Figure 13A:
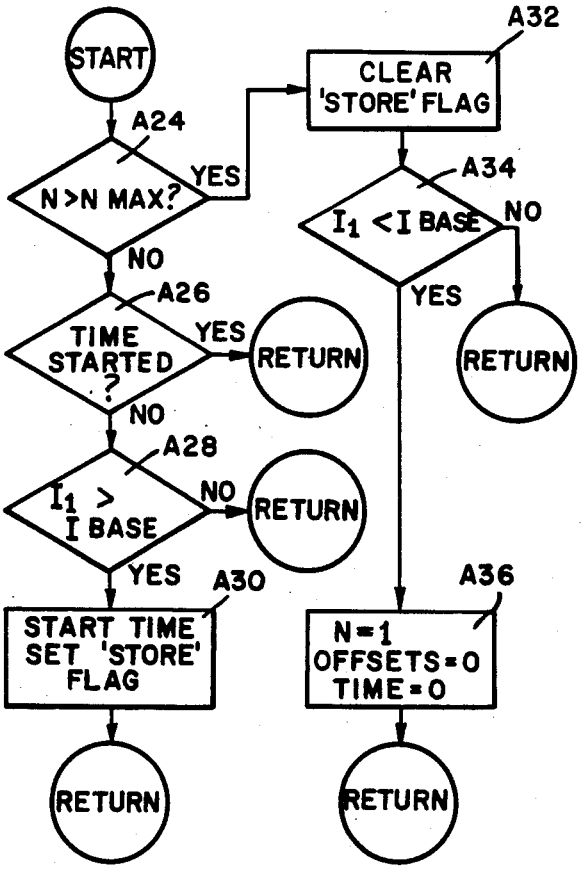
FIGS. 13A, 13B, and 13C are a detailed flow charts of the operation of the routines for parameter profile storage illustrated in FIG. 12 and are called from the main program.

FIG. 13A illustrates a detailed flow chart for the routine which monitors stand 1 current, implementing block All of FIG. 12. The program determines if a new billet has arrived at stand 1, in which case the program initiates the correction cycle for the new billet, and also determines if a billet has reached stand $N_{MAX}$, in which case the correction cycle is ended until a new billet arrives.

The program begins by determining whether variable N is greater than $N_{MAX}$. The variable N in this routine is equal to the stand number that the controller 26 is presently addressing. If the controller has already set speed ratios for all of the stands in the train, then N will be greater than $N_{MAX}$ so that an affirmative branch will cause the program to proceed to block A32, where the Store flag is cleared thereby disabling the profile storage routines described below. In block A34, the present current for stand 1 is tested to determine if it is less than the base value of no-load current. An affirmative response indicates that the billet for which the correction cycle has been completed has left stand 1. In this case, the system variables are reset by block A36 to prepare for arrival of the next billet, and the program returns from this routine. If the test in block A34 is negative, the billet is still being rolled by stand 1, so the program returns without resetting N. On subsequent passes through this routine, N will continue to exceed $N_{MAX}$ in block A24 until an affirmative result in block A24 causes N to be reset to 1.

Assuming the controller 26 is just beginning the process, or that N has been reset, the negative branch from block A24 will be taken to block A26. Here the system determines whether the real time clock has been started by testing whether the parameter TIME is not zero. A positive response causes a return to the main program, since this means the correction cycle has already been started. A negative branch leads to block A28, where the current in stand 1 is compared to the base or no-load value. If the current is less than the base value, a return is made to the main program. If the current is greater than the base value, indicating the arrival of a new billet at stand 1, the correction cycle for the new billet is initiated by block A30, which starts the real time clock and sets the Store flag enabling subsequent profile storage.

After the correction cycle is initiated, on subsequent passes this routine will pass through the negative branch from A24 and the positive branch from A26 until the correction cycle is complete, at which time the value N will exceed $N_{MAX}$ and the correction cycle will end with a positive branch from A24.

Figure 13B:
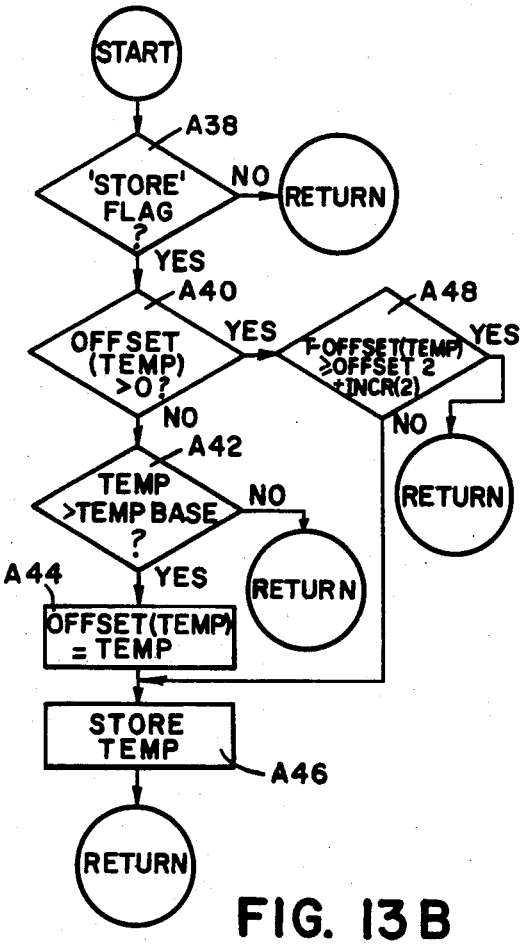

FIG. 13B is a representative flow chart of the temperature profile storage routine, which stores sufficient temperature data to permit the calculation of temperature compensating factors in the subsequent tension correction routines. The data required is the temperature profile of the material from the arrival of the billet at the pyrometer 36 for a period of time equal to the travel of the billet from stand 1 to a point just ahead of stand 3. This routine begins by testing in block A38 whether the Store flag has been set by the stand 1 monitor routine of FIG. 13A. If not, the correction cycle is inactive so the routine returns immediately. If the flag is set, block A40 tests the value OFFSET(TEMP). If this value is zero, the new billet has not reached the pyrometer 36 so a branch is made to block A42 which tests whether the temperature parameter is greater than a base temperature value. If it is not, the routine simply returns to the main program. However, an affirmative answer to this test indicates that the nose of the billet 12 is just starting to pass under the pyrometer 36. This causes a branch to block A44 which initiates the temperature profile storage by setting the parameter OFFSET(TEMP) equal to the current value of the real time clock parameter TIME. Control then passes to block A46 which stores the value of the TEMP parameter in a table in memory reserved for the temperature profile.

On subsequent passes through this routine, the value of OFFSET(TEMP) will be greater than zero, causing a positive branch from block A40 to block A48. This block tests to determine whether sufficient temperature profile data has been stored. If the value TIME−OFFSET(TEMP) is greater that OFFSET2+INCR2, then the routine simply returns to the main program. Otherwise, more data is needed, and control passes to block A46 which stores the value of the TEMP parameter in the next available location in the temperature profile storage area.

Figure 13C:
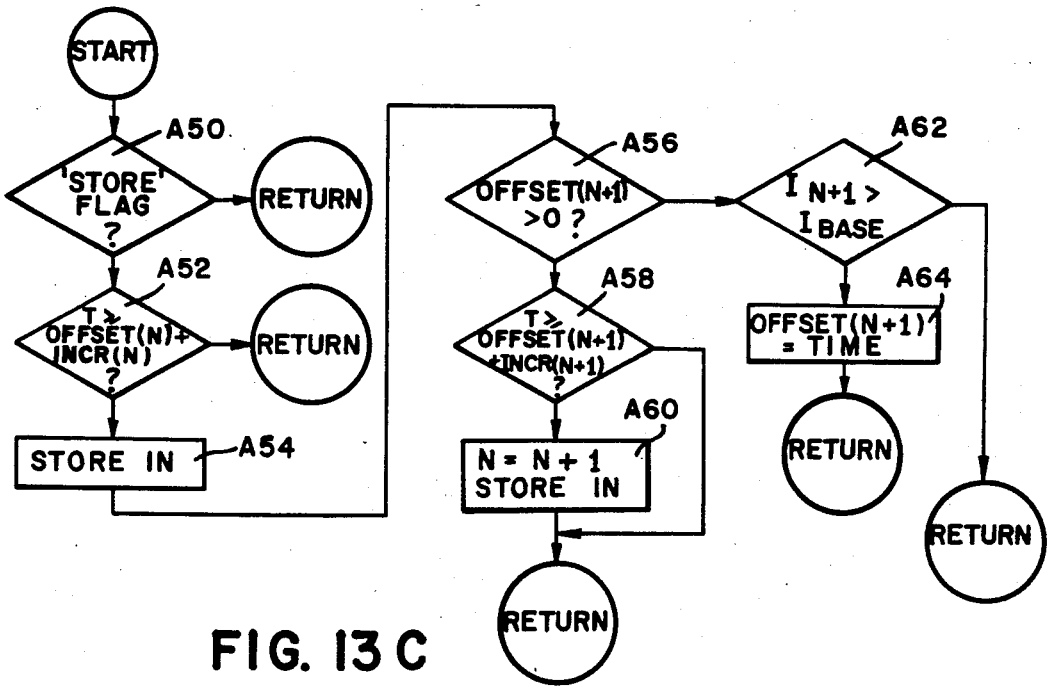

FIG. 13C is a representative flow chart of the routine which implements the current profile storage shown in block A13 of FIG. 12. This routine determines which stand is to be corrected, and stores the current profile for each stand N from time OFFSET(N) +INCR2(N) when the billet is about to enter stand N+1 to time OFFSET(N+1) +INCR2(N+1) when the billet is about to enter stand N+2.

The routine begins by testing in block A50 whether the Store flag has been set by the monitor routine of FIG. 13A. If not, the correction cycle is inactive, so the routine simply returns to the main program. If the Store flag is set, control transfers to block A52 which determines if the real time clock parameter TIME is greater than OFFSET(N)+INCR2(N). If not, the storage interval for stand N has not begun, so the routine returns to the main program. A positive branch from block A52 causes the value of parameter $I_N$ to be stored in the area in memory reserved for the current profile table. Then block A56 tests whether the value OFFSET(N+1) is greater than zero. If not, the current $I_{N+1}$ of stand N+1 is tested in block A62 to determine if it is greater than a base no-load value. A positive result causes block A64 to set the value, of OFFSET(N+1) equal to the present value of the real time clock parameter TIME. A negative branch from block A62 simply causes a return to the main program.

Once the billet has reached stand N+1 and the value of parameter OFFSET(N+1) has been set, subsequent passes through this routine will take the positive branch from block A56 to block A58. Block A58 determines if the value of the real time clock parameter TIME is greater than the value of OFFSET(N+1) +INCR2(N+1). A negative result causes a return to the main program. A positive result indicates that the correction interval for stand N is over, since the billet is about to enter stand N+2. The positive branch leads to block A60 which initiates the correction interval for the next stand in sequence by incrementing the value of parameter N by 1 and storing the present value of the current $I_N$ for the new value of N as the first element of the current profile for that stand.

Figure 14:
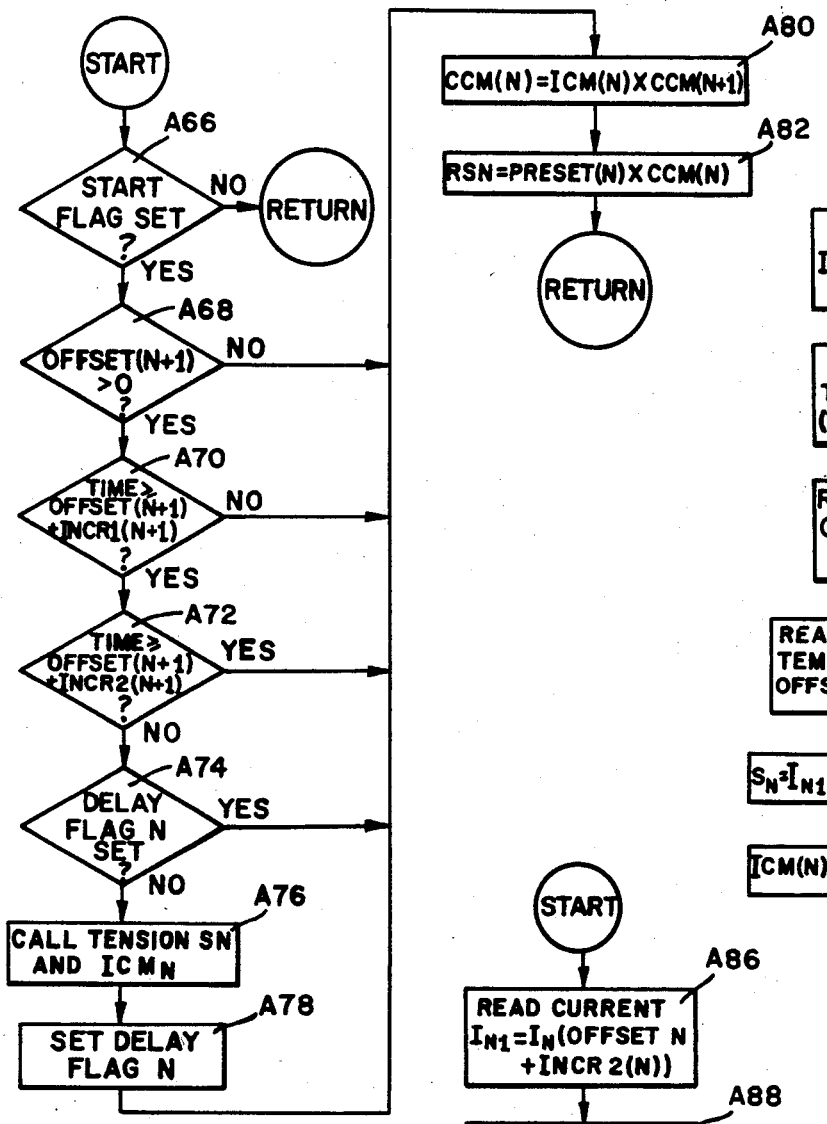
FIG. 14 is a detailed flow chart of the operation of one of the reference speed signal generation routines illustrated in FIG. 12 and called from the main program.

FIG. 14 is a representative flow chart embodiment of one of the reference speed calculation routines illustrated as block A14, . . A18 in FIG. 12. This routine determines whether the tension control interval for stand N is active, and if so, it calculates the tension correction for stand N. The routine then generates an updated speed reference.

The routine begins in block A66 by testing whether a Start flag has been set. If the operator has stopped the process for some reason, or has not yet started the flow of the material into the mill train, then the program will immediately return and the reference speed signal to the motor will remain zero. If, however, the Start flag has been set, then the tests in blocks A68 to A74 determine whether a tension correction should be made to stand N. Block A68 tests whether the value OFFSET(N+1) is greater than zero. A negative branch indicates that the billet has not reached stand N+1 so the correction interval for stand N has not begun and control passes directly to block A80. A positive branch from A68 causes block A70 to determine whether the parameter TIME is greater than the value OFFSET(N+1-)+INCR1(N+1). If the test is negative, then this means that the billet has not yet reached the position in the train where stand N should be controlled, and program control passes to block A80.

A positive branch from A70 causes block A72 to determine whether the parameter TIME is greater than the value OFFSET(N+1) +INCR2(N+1). If this test is positive, then this means that the billet has passed the position in the train where the correction interval for stand N should cease, so control passes to block A80. A negative branch from block A72 causes block A74 to test to determine whether the delay flag for stand N is set. A positive branch leads directly to block A80. The delay flag for stand N being set indicates that a speed correction has recently taken place and the system must be allowed to settle before another correction is made. If the test in block A74 is negative, all the conditions are satisfied to allow a correction to be made to stand N to reduce the calculated tension between stands N and N+1. In this case, the routine proceeds to block A76 where the tension parameter $S_N$ and the corresponding individual correction multiplier $ICM_N$ are calculated. Following this, the delay flag for stand N is set in block A78. Setting the delay flag for stand N will cause a counter to count to a preset control delay before the flag is cleared. Control then passes to block A80. Whether the value of $ICM_N$ is updated or not, block A80 calculates a new value of the cascade correction multiplier $CCM_N$ and block A82 calculates a new speed reference value RSN which is output to the speed control means for stand N.

Figure 15:
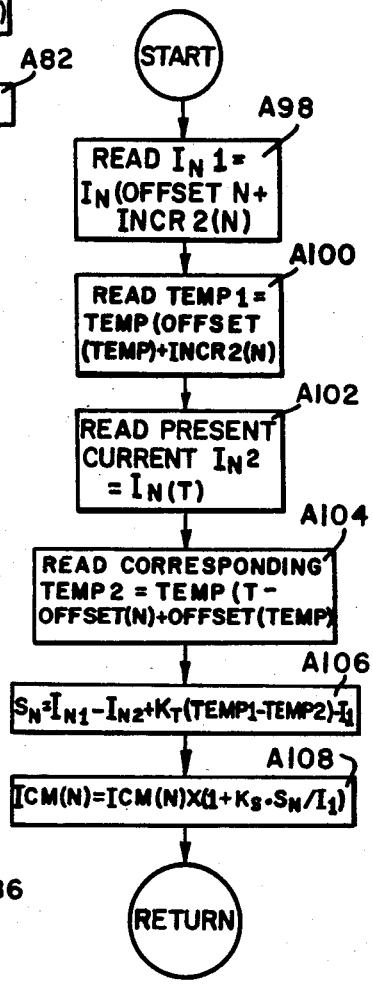
FIGS. 15 and 16 are detailed flow charts of alternate embodiments of the subroutine for calculating the correction factor $S_N$ illustrated in FIG. 14 and called from that routine.

FIG. 15 is a representative flow chart of one embodiment of a routine for calculating the tension factor $S_N$ and the individual correction factor $ICM_N$, implementing the function of block A76 of FIG. 14. In block A98, the no-tension current $I_N$(OFFSET(N)+INCR2(N)) is retrieved from the current profile table for stand N. In block A100, the corresponding material temperature is read from the temperature profile table. Since the current reading is that which occurred INCR2 seconds after the arrival of the head end of the billet at stand N, the corresponding temperature reading is that which occurred INCR2 seconds after the arrival of billet at the pyrometer 36. In blocks A102 and A104, the present current value $I_N2$ (t2) and the corresponding temperature TEMP2 are retrieved. As above, the appropriate temperature value is that which occurred at the same time relative to the arrival of the billet at pyrometer 36 as the time relative to the arrival of the billet at stand N at which the current was measured. Blocks A106 and A108 implement equations 1 and 2. The form of block A108 will cause the value $ICM_N$ to accumulate the effects of successive tension approximations $S_N$ during each correction internal.

Figure 16:
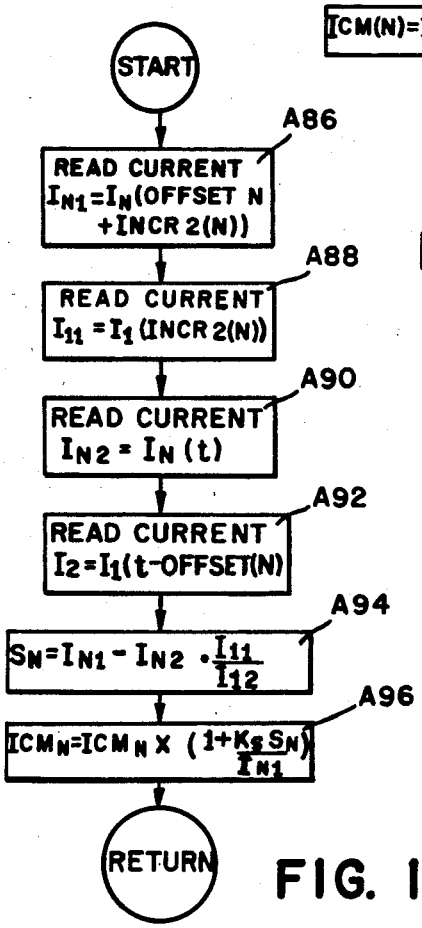

A flow chart for a second embodiment of the routine implementing block A76 of FIG. 14 is illustrated in FIG. 16. In blocks A86 and A88, the value of no-tension current $I_N$(t1) and the corresponding value of stand 1 current $I_1$(t1-OFFSET(N)) are read from the profile storage tables. In blocks A90 and A92 the present value of stand N current, $I_N$(t2), and the corresponding current of stand 1,$I_1$(t2-OFFSET(N)), are read. Blocks A94 and A96 implement equations 6 and 7. The form of block A96 will have the effect of causing the value $ICM_N$ to accumulate the effects of successive tension approximations $S_N$ during each correction interval.

While a preferred embodiment of the invention has been illustrated, it will be obvious to those skilled in the art that various modifications and changes may be made thereto without departing from the spirit and scope of the invention as defined in the appended claims.

What is claimed is:

1. A control system for a continuous rolling mill having a plurality of motors for driving a corresponding number of rolling mill stands, said system comprising:

means for measuring the actual speed of each motor and for generating actual speed signals indicative of the measured speeds;

means for controlling the speed of each motor by comparing corresponding generated reference speed signals with said actual speed signals and by controlling the motor speeds in a direction which tends to null the difference between said reference speed signals and said actual speed signals;

means for measuring the current drawn by each motor and for generating actual current signals indicative of the measured currents;

means for measuring the temperature at the surface of a workpiece rolled in said rolling mill and for generating a temperature signal indicative of the measured temperature;

means for storing a plurality of temperature values comprising a temperature profile of said temperature signal and representing the surface temperature of the workpiece as a function of time and position for a predetermined interval and length, said predetermined interval and length corresponding to substantially the time and length of the workpiece required to travel between one of the plurality of rolling stands and the next of the plurality of rolling stands; and means for generating said reference speed signals in order to reduce workpiece tension between successive rolling stands to a minimum, said reference speed signal generating means calculating the reference speed signal for a motor based on a no tension current measurement, a plurality of tension current measurements, and temperature values from said stored temperature profile corresponding to said tension and no tension current measurements.

2. A control system as set forth in claim 1 wherein said reference speed signals generating means calculates a reference speed signal for a rolling stand N based on the relationship:

$$S_N = I_N(t1) - I_N(t2) + K_T(TEMP(t1) - TEMP(t2-))I_N(t1)$$

where $S_N$=tension current between two successive rolling stands N, N+1;

$I_N$(t1)=the current drawn by the motor of stand N for a no tension condition at time t1;

$I_N$(t2)=the current drawn by the motor of stand N for a tension condition at time t2;

$K_t$=a proportionality constant relating a change in temperature to a change in current for a motor of rolling stand N;

TEMP(t1)=the temperature of the surface of said workpiece at the location of stand N at time t1; and TEMP(t2)=the temperature of the surface of said workpiece at the location of stand N at time t2.

3. A control system as set forth in claim 2 wherein said reference speed signals generating means include:

means for correcting said reference speed signal of rolling stand N in a direction tending to null $S_N$.

4. A control system as set forth in claim 3 wherein said reference speed signal generating means includes:

means for correcting said reference speed signal after a tension occurs when the workpiece enters the next subsequent rolling stand but before the workpiece enters the stand following said subsequent stand.

5. A method of controlling the motor speeds between adjacent mill stands of a continuous rolling mill to reduce tractive forces in a rolled material including the steps of:

measuring a first value of current $I_N(t1)$ drawn by a mill stand motor N at time t1 when there is no tractive force in the rolled material;

measuring a first temperature TEMP1 at the surface of the rolled material while positioned at stand N and corresponding to the time t1 when said first value of current is measured;

measuring a second value of current $I_N(t2)$ drawn by said mill stand motor N at time t2 when there is a tractive force in the rolled material;

measuring a second temperature TEMP2 at the surface of the rolled material while positioned at stand N and corresponding to the time t2 when said second value of current is measured; generating a correction factor $S_N$ of the form:

$$S_N = I_N(t1) - I_N(t2) + K_T(TEMP1 - TEMP2)I_N(t1)$$

where $S_N$=tension current between two successive rolling stands N, N+1;

$I_N(t1)$=the current drawn by the motor of stand N for a no tension condition at time t1;

$I_N(t2)$=the current drawn by the motor of stand N for a tension condition at time t2;

$K_T$=a proportionality constant relating a change in temperature to a change in current for a motor of rolling stand N;

TEMP(t1)=the temperature of the surface of said workpiece at the location of stand N at time t1; and TEMP(t2)=the temperature of the surface of said workpiece at the location of stand N at time t2; and correcting one of the said mill stand motor speeds in a direction tending to null $S_N$.

6. A method as defined in claim 5 wherein said step of correcting said motor speeds includes:

generating an incremental correction signal as a proportional part of the correction factor $S_N$;

integrating said incremental correction signal into a total correction signal; and combining said correction signal with a speed reference signal of a closed loop speed controller governing the speed of said one mill stand motor.

7. A method as defined in claim 6 wherein:

said steps of generating a correction signal are terminated upon either of the conditions of $S_N$ being equal to zero or a correction interval expiring.

8. A method as defined in claim 7 which further including the steps of:

storing the ratio of the speeds of said mill stand motors upon the termination of the correction signal generation; and controlling the speeds of one of said mill stand motors to maintain said stored speed ratio.

9. A method of controlling the motor speeds between adjacent mill stands of a continuous rolling mill to reduce tractive forces in a rolled material including the steps of:

measuring a first value of current $I_N(t1)$ drawn by a mill stand motor N at time t1 when there is no tractive force in the rolled material;

measuring a second value of current $I_N(t2)$ drawn by said mill stand motor N at time t2 when there is a tractive force in the rolled material;

generating a current correction profile which has values of correction current different from an average current due to temperature variations in the rolled material, said profile comprising at least two values $I_1(t1)$, $I_1(t2)$ corresponding to the times said first and second values of current are measured; and generating a correction factor $S_N$ of the form:

$$S_N = I_N(t1) - I_N(t2) \times \frac{I_1(t1 - \text{OFFSET}(N))}{I_1(t2 - \text{OFFSET}(N))}$$

where $S_N$=tension current between two successive rolling stands N, N+1;

$I_N(t1)$=the current drawn by the motor of stand N for a no tension condition at time t1;

$I_N(t2)$=the current drawn by the motor of stand N for a tension condition at time t2;

$I_1(t)$=current of stand 1 at time t;

OFFSET(N)=time between stand 1 and stand N; and correcting the speed of said mill stand motor N in a direction tending to null $S_N$.

10. A cascade speed controller for a plurality of rolling mill stands of a continuous rolling mill having a closed loop motor speed controller associated with each stand, wherein each closed loop motor speed controller controls the actual speed of a motor of an associated rolling mill stand to follow a speed reference signal, said cascade speed controller comprising:

means for measuring the current drawn by each motor and for generating actual current signals indicative of the measured currents;

means for measuring the temperature at the surface of a workpiece rolled in said rolling mill and for generating a temperature signal indicative of the measured temperature;

means for storing a plurality of temperature values comprising a temperature profile of said temperature signal and representing the surface temperature of the workpiece as a function of time and position for a predetermined interval and length, said predetermined interval and length corresponding to substantially the time and length of the workpiece required to travel between one of the plurality of rolling stands and the next of the plurality of rolling stands;

means for generating an associated reference speed signal for each of said motor speed controllers;

means for generating an associated individual correction signal for each stand as a function of a no tension current measurement, a plurality of tension current measurements, and temperature values from said stored temperature profile corresponding to said tension and no tension current measurements;

means for modifying each reference speed signal by said associated individual correction signal; and means for combining said individual correction signals such that any individual correction signal associated with a rolling stand and the individual correction signal for the subsequent rolling stand.

11. A cascade speed controller as set forth in claim 10 wherein said combining means includes:

first multiplying means for generating the product of said reference speed signal and a correction factor;

second multiplying means for generating said correction factor as the product of said associated individual correction signal and a cascade multiplication factor; and said cascade multiplication factor being formed as the correction factor for the subsequent mill stand.

12. A cascade speed controller as set forth in claim 10 wherein said correction signal generating means includes:

means for integrating a correction factor ratio $S_N/I_1$, where $S_N$ is a correction factor based upon a motor current difference and associated temperature difference and $I_1$ is a no tension current value; and means for generating the sum of said integrated correction factor ratio and a unity gain factor.

13. A cascade speed controller as set forth in claim 12 wherein said correction signal generating means further includes:

means for multiplying said correction factor ratio $S_N/I_1$ by a scaling constant $K_S$.

14. A cascade speed controller as set forth in claim 12 wherein said correction factor $S_N$ is given by the equation:

$$S_N = I_N(t1) - I_N(t2) + K_T(TEMP1 - TEMP2)I_N(t1)$$

where $S_N$=tension current between two successive rolling stands;

$I_N(t1)$=the current drawn by the motor of stand N for a no tension condition at time t1;

$I_N(t2)$=the current drawn by the motor of stand N for a tension condition at time t2;

$K_T$=a proportionality constant relating a change in temperature to a change in current for a motor of mill stand N;

TEMP(t1)=the temperature of the surface of said workpiece at this location of stand N at time t1; and TEMP(t2)=the temperature of the surface of said workpiece at the location of stand N at time t2.

15. A cascade speed controller as set forth in claim 12 wherein said correction factor $S_N$ is given by the equation:

$$S_N = I_N(t1) - I_N(t2) \times \frac{I_1(t1 - \text{OFFSET}(N))}{I_1(t2 - \text{OFFSET}(N))}$$

where $S_N$=tension current between two successive rolling stands N, N+1;

$I_N(t1)$=the current drawn by the motor of stand N for a no tension condition at time t1;

$I_N(t2)$=the current drawn by the motor of stand N for a tension condition at time t2;

$I_1(t)$=current of stand 1 at time t; and

OFFSET(N)=time between stand 1 and stand N.

16. A cascade speed controller as set forth in claim 10 wherein said correction signal generating means includes:

means for integrating a correction factor sum:

$$1 - I_N(t2)/I_N(t1) + K_T(\text{TEMP1} - \text{TEMP2})$$

where $S_N$=tension current between two successive rolling stands N, N+1;

$I_N(t1)$=the current drawn by the motor of stand N for a no tension condition at time t1;

$I_N(t2)$=the current drawn by the motor of stand N for a tension condition at time t2;

$K_T$=a proportionality constant relating a change in temperature to a change in current for a motor of rolling stand N;

TEMP(t1)=the temperature of the surface of said workpiece at the location of stand N at time t1; and TEMP(t2)=the temperature of the surface of said workpiece at the location of stand N at time t2; and means for generating the sum of said correction factor sum and a unity gain factor.

17. A cascade speed controller as set forth in claim 16 wherein said correction signal generating means further includes:

means for multiplying said correction factor sum by a scaling constant $K_S$.

18. A cascade speed controller as set forth in claim 10 wherein said correction signal generating means includes:

means for integrating a correction factor sum;

$$1 - \frac{I_N(t2)}{I_N(t1)} \times \frac{I_1(t1 - \text{OFFSET}(N))}{I_1(t2 - \text{OFFSET}(N))}$$

where $S_N$=tension current between two successive rolling stands N, N+1;

$I_N(t1)$=the current drawn by the motor of stand N for a no tension condition at time t1;

$I_N(t2)$=the current drawn by the motor of stand N for a tension condition at time t2;

$I_1(t)$=current of stand 1 at time t; and

OFFSET(N)=time between stand 1 and stand N; and means for generating the sum of said correction factor sum and a unity gain factor.

19. A cascade speed controller as set forth in claim 18 wherein said correction signal generating means further includes:

means for multiplying said correction factor sum by a scaling constant $K_S$.

20. A cascade speed controller for a plurality of rolling mill stands of a continuous rolling mill having a closed loop motor speed controller associated with each stand, each closed loop motor speed controller modifying the actual speed of a motor of an associated rolling stand to follow a speed reference signal, said cascade speed controller comprising:

means for measuring the current drawn by each motor and for generating actual current signals indicative of the measured currents;

means for measuring the temperature at the surface of a workpiece rolled in said rolling mill and for generating a temperature signal indicative of the measured temperature;

means for storing a plurality of temperature values comprising a temperature profile of said temperature signal and representing the surface temperature of the workpiece as a function of time and position for a predetermined interval and length, said predetermined interval and length corresponding to substantially the time and length of the workpiece required to travel between one of the plurality of rolling stands and the next of the plurality of rolling stands;

means for generating a reference speed signal for each of said motor speed controllers in sequence wherein each reference speed signal is generated as a function of a no tension current measurement, a plurality of tension current measurements, and temperature values from said stored temperature profile corresponding to said tension and no tension current measurements, said reference speed signals reducing tension between adjacent mill stands by setting a no tension speed ratio; and means for adjusting the speed ratio between adjacent stands to said no tension speed ratio based upon a speed adjustment to one of said adjacent stands caused by reducing tension between one of said adjacent stands and another stand in said sequence.

* * * * *

UNITED STATES PATENT AND TRADEMARK OFFICE

CERTIFICATE OF CORRECTION

PATENT NO. : 4,662,202

DATED : May 5, 1987

INVENTOR(S) : William Allen Lambert

It is certified that error appears in the above-identified patent and that said Letters Patent is hereby corrected as shown below:

Column 3, Line 25, change "$I_n$" to --$I_N$--.

Column 5, Line 29, change "FIGS." to --FIG.--.

Column 5, Line 47, after "are" delete "a".

Column 5, Line 50, after ";" delete ",".

Column 7, Line 43, after "124", change ";" to --,--.

Column 9, Line 61, change "FIG. 6A, B, C and D" to --FIGS. 6A, 6B, 6C and 6D--.

Column 10, Line 17, change "$I_{(}(t)$" to --$I_1(t)$--.

Column 10, Line 28, change "or" to --of--.

Column 10, Line 47, change "or" to --of--.

Column 10, Line 54, change "or" to --of--.

Column 11, Line 1, change "consrant" to --constant--.

Column 11, Line 47, change "then" to --than--.

Column 11, Line 53, change "$I_N(t2))$" to --$I_N(t2)$.

Column 13, Line 40, change "$K_s$" to --$K_S$--.

Column 14, Line 11, after "and" insert --,--.

UNITED STATES PATENT AND TRADEMARK OFFICE

CERTIFICATE OF CORRECTION

PATENT NO. : 4,662,202

DATED : May 5, 1987

INVENTOR(S) : William Allen Lambert

It is certified that error appears in the above-identified patent and that said Letters Patent is hereby corrected as shown below:

Column 14, Line 18, change "$K_s$" to --$K_S$--.

Column 16, Line 23, change "millisecond" to --milliseconds--.

Column 17, Line 66, change "that" to --than--.

Column 18, Line 27, after "value" delete ",".

Column 20, Line 58, change "$K_t$" to --$K_T$--.

Column 24, Line 20, after "and" insert a new paragraph.

Signed and Sealed this

Fifteenth Day of September, 1987

*Attest:*

DONALD J. QUIGG

*Attesting Officer*

*Commissioner of Patents and Trademarks*